US010052873B2

(12) United States Patent
Ashikaga et al.

(10) Patent No.: US 10,052,873 B2
(45) Date of Patent: Aug. 21, 2018

(54) INKJET APPARATUS AND MANUFACTURING METHOD OF INKJET APPARATUS

(71) Applicant: ROHM CO., LTD., Kyoto (JP)

(72) Inventors: Kinya Ashikaga, Kyoto (JP); Kunio Iida, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/694,329

(22) Filed: Sep. 1, 2017

(65) Prior Publication Data

US 2017/0361614 A1 Dec. 21, 2017

Related U.S. Application Data

(63) Continuation of application No. 14/876,374, filed on Oct. 6, 2015, now Pat. No. 9,776,405.

(30) Foreign Application Priority Data

| | | |
|---|---|---|
| Oct. 8, 2014 | (JP) | 2014-207562 |
| Oct. 8, 2014 | (JP) | 2014-207563 |
| Oct. 8, 2014 | (JP) | 2014-207565 |
| Aug. 5, 2015 | (JP) | 2015-155237 |

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1629* (2013.01); *B41J 2/1631* (2013.01); *B41J 2/1646* (2013.01); *B41J 2002/14241* (2013.01); *B41J 2002/14459* (2013.01); *B41J 2002/14491* (2013.01)

(58) Field of Classification Search
CPC .. B41J 1/14233; B41J 1/14274; B41J 1/1612; B41J 1/161; B41J 1/1629; B41J 1/1631; B41J 1/1646
See application file for complete search history.

(56) References Cited

U.S. PATENT DOCUMENTS

| | | | | |
|---|---|---|---|---|
| 2008/0211880 | A1* | 9/2008 | Hara | B41J 2/161 347/70 |
| 2013/0135400 | A1 | 5/2013 | Yazaki et al. | |
| 2013/0222487 | A1 | 8/2013 | Ozawa et al. | |

FOREIGN PATENT DOCUMENTS

| | | | |
|---|---|---|---|
| JP | 2013-091272 | A | 5/2013 |

* cited by examiner

*Primary Examiner* — Juanita D Jackson
(74) *Attorney, Agent, or Firm* — Rabin & Berdo, P.C.

(57) ABSTRACT

An inkjet apparatus capable of achieving a good withstand voltage in a movable part of a piezoelectric element is provided. An inkjet apparatus is provided, wherein the inkjet apparatus comprises: an actuator substrate, partitioning a cavity for accumulating ink; a vibrating film, supported by the actuator substrate and partitioning the cavity; and a piezoelectric element, on the vibrating film, and comprising an upper electrode, a lower electrode, and a piezoelectric film between the upper electrode and the lower electrode; wherein the piezoelectric film extends along a space covering the whole cavity; and the upper electrode is constrained in an inner space of the cavity.

11 Claims, 52 Drawing Sheets

1

1

INKJET APPARATUS AND MANUFACTURING METHOD OF INKJET APPARATUS

CROSS-REFERENCE TO RELATED APPLICATION

The present application is a Continuation Application of U.S. application Ser. No. 14/876,374, filed on Oct. 6, 2015, and issued as U.S. Pat. No. 9,776,405, which is herein incorporated by reference.

BACKGROUND

The present invention relates to an inkjet apparatus and a manufacturing method of an inkjet apparatus.

PRIOR TECHNICAL LITERATURE

An inkjet type recording head is disclosed in patent literature 1. Specifically, the inkjet type recording head of the patent literature 1 comprises a pressure generating chamber communicating with a nozzle outlet; and a piezoelectric element comprising a piezoelectric layer, and an electrode provided on the piezoelectric layer. Ink stored in the pressure generating chamber is jetted through the nozzle outlet.

PATENT LITERATURE

[Patent literature 1] Japanese Patent Application Publication No. 2013-91272.

BRIEF SUMMARY OF THE INVENTION

Problems to be Solved in the Present Invention

In the inkjet type recording head of the patent literature 1, the piezoelectric layer including PZT (Lead Zirconate Titanate) is formed in a size constrained in the inner space of the pressure generating chamber. Such piezoelectric layer can be provided by laminating a PZT film by, for example, a MOD (Metal Organic Decomposition) method or a sol-gel method, and then patterning the PZT film.

However, it is difficult to perform the etching with high accuracy so as to hold the PZT within a prescribed area. Accordingly, the structure disclosed in the patent literature 1 is difficult to be produced with a high yield. Also, the damage caused by etching occurs in the side surface of the PZT. Because of the damage, the withstand voltage between an upper electrode and a lower electrode in a movable part degrades, and this degrading of the withstand voltage occurs in a structure, such as the structure of the peripheral edge of the PZT film arranged in the interior of the pressure generating chamber.

In one embodiment of the present invention, an inkjet apparatus capable of achieving a good withstand voltage in a movable part of a piezoelectric element is provided.

Also, in one embodiment of the present invention, a manufacturing method of an inkjet apparatus capable of manufacturing an inkjet apparatus, which can achieve a good withstand voltage in a movable part of a piezoelectric element with a high yield, is provided.

Technical Means for Solving the Problems

In one embodiment of the present invention an inkjet apparatus is provided, wherein the inkjet apparatus includes:

an actuator substrate, partitioning a cavity for accumulating ink; a vibrating film, supported by the actuator substrate and partitioning the cavity; and a piezoelectric element, on the vibrating film, and including an upper electrode, a lower electrode, and a piezoelectric film between the upper electrode and the lower electrode; wherein the piezoelectric film is extended along a space covering the whole cavity, and the upper electrode is constrained in an inner space of the cavity.

As a driving voltage is applied to the piezoelectric element, the vibrating film displaces together with the piezoelectric element, and the volume change of the cavity occurs. Thus, ink in the cavity is ejected. In the piezoelectric element, a region for forming the piezoelectric film is not constrained in the inner space of the cavity. As a result, the piezoelectric film can be processed (etched) easily during the patterning of the piezoelectric film. Thus, the yield of the inkjet apparatus can be improved. Also, the peripheral edge of the piezoelectric film is set at least in the outer space of the cavity (i.e., the outer space of the movable part of the piezoelectric element). Accordingly, even if the peripheral edge of the piezoelectric film is damaged by etching, degradation of the withstand voltage of the piezoelectric element caused by the damage can still be prevented.

In one embodiment of the present invention, the lower electrode includes a contact integrally drawn out to an outer space of the cavity, and the piezoelectric film surrounds the contact.

In one embodiment of the present invention, an ink passage communicating with the cavity is further formed, and the piezoelectric film surrounds the ink passage.

Although the piezoelectric film may be exposed on the side surface of an ink feed passage, a region for forming the ink feed passage is not a movable part of the piezoelectric element. Therefore, the exposure of the piezoelectric film will not poorly affect the piezoelectric performance.

In one embodiment of the present invention, the piezoelectric film includes a PZT film.

In one embodiment of the present invention, the thickness of the piezoelectric film is between 1 μm and 5 μm.

As mentioned above, the piezoelectric film can be processed (etched) easily so that even if the piezoelectric film has a thickness between 1 μm and 5 μm, a sufficient withstand voltage can be secured.

In one embodiment of the present invention, the vibrating film includes a $SiO_2$ mono-layer film.

In one embodiment of the present invention, the vibrating film includes a $SiN/SiO_2$ laminated film.

In one embodiment of the present invention, the upper electrode includes a Pt mono-layer film.

In one embodiment of the present invention, the lower electrode includes a Pt/Ti laminated film.

One embodiment of the present invention further includes a nozzle substrate, wherein the nozzle substrate supports the actuator substrate and partitions the cavity, and includes a nozzle outlet communicating with the cavity.

In one embodiment of the present invention, a manufacturing method of an inkjet apparatus is provided, wherein the method includes the following steps: forming a vibrating film on an actuator substrate; forming a lower electrode film, a piezoelectric film, and an upper electrode film successively on the vibrating film; forming an upper electrode with a predetermined shape by selectively etching the upper electrode film; selectively etching the piezoelectric film, thereby leaving the remaining piezoelectric film in a region surrounding the upper electrode; and etching the actuator substrate from a lower side to form a cavity covering the whole upper electrode, and the cavity is constrained in an inner space of the remaining piezoelectric film.

In one embodiment of the present invention, the piezoelectric film is selectively etched so that a partial region of the lower electrode film is exposed as a contact.

One embodiment of the present invention further includes forming an ink passage through the piezoelectric film and into the cavity.

According to the method, a piezoelectric film is capable of being processed into a pattern surrounding the ink feed passage.

DETAILED DESCRIPTION

Figure 1:
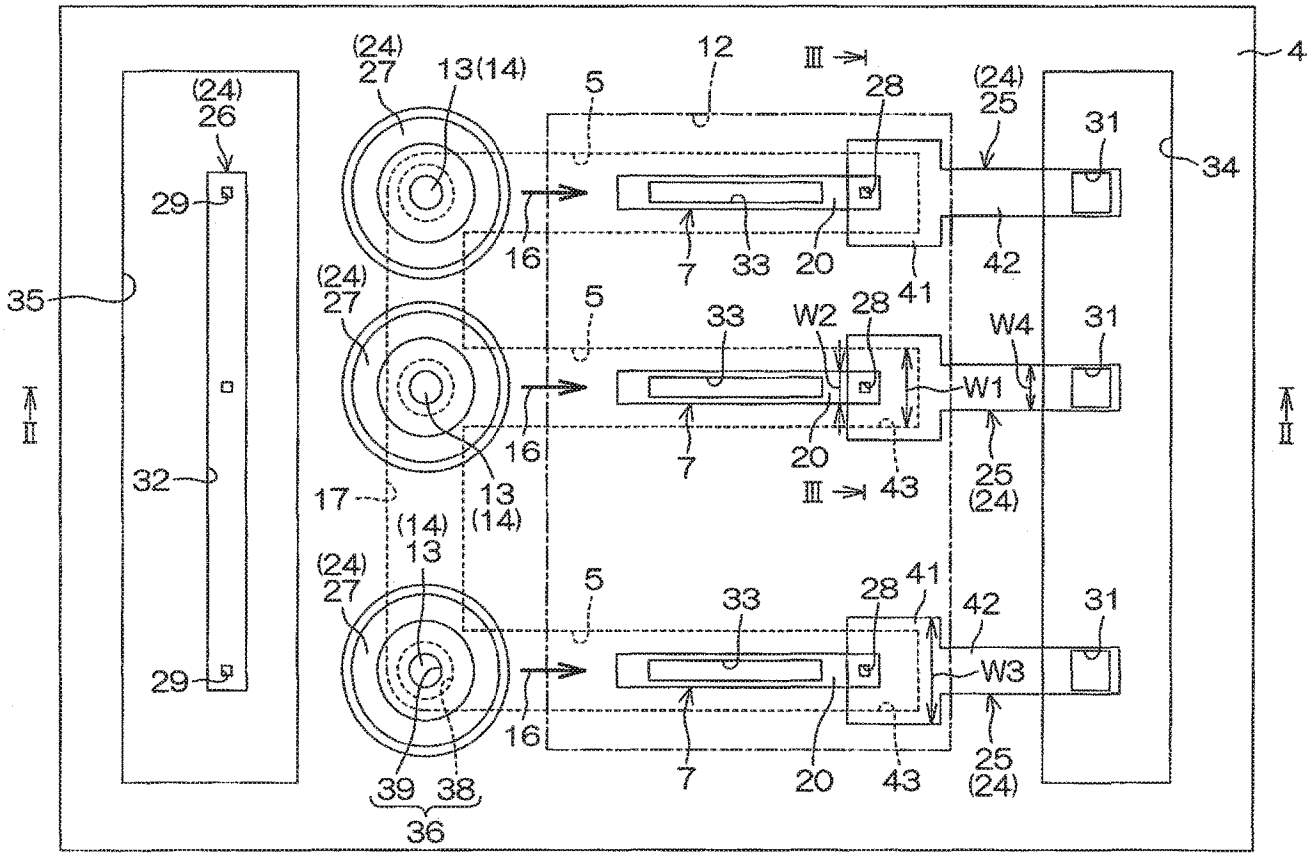
FIG. 1 is a schematic plan view for illustrating a structure of an inkjet apparatus in one embodiment of the present invention.
Figure 2:
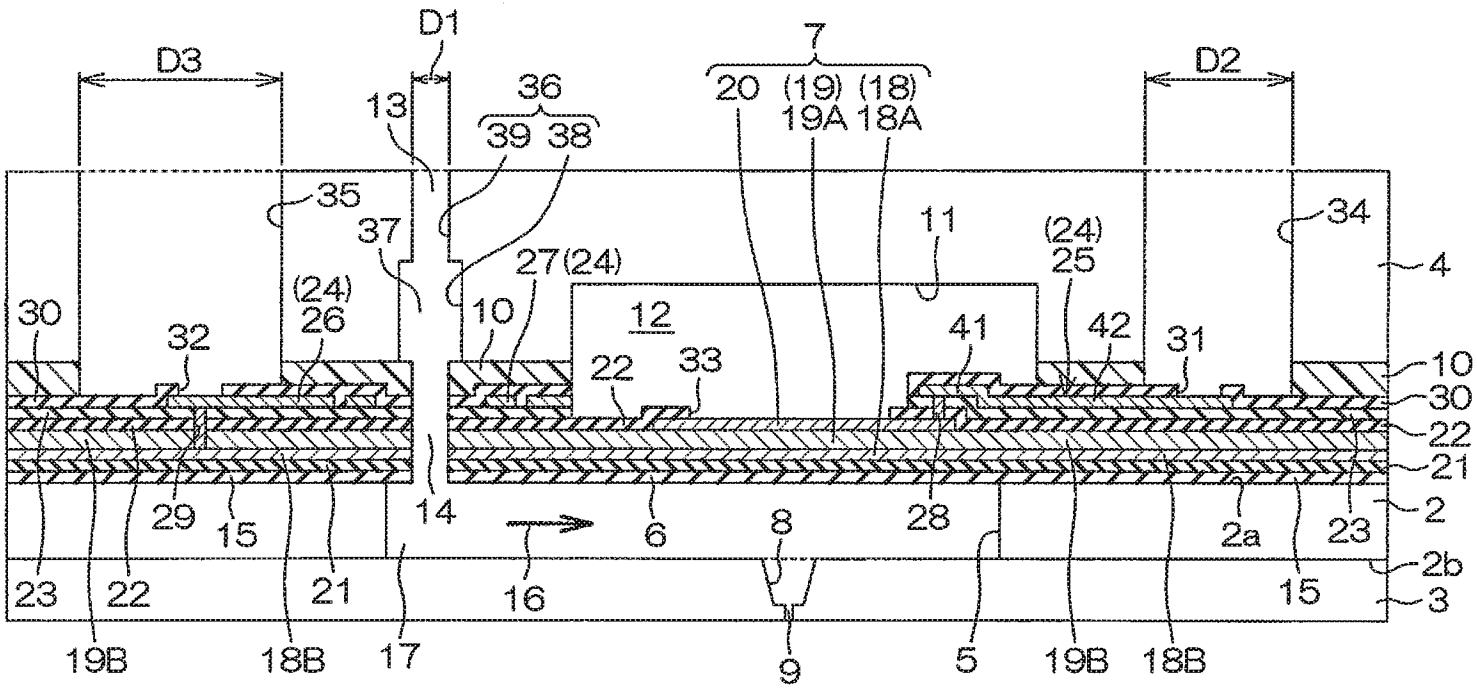
FIG. 2 is a cross-sectional view of the inkjet apparatus (a cross-sectional view of the line in FIG. 1).
Figure 3:
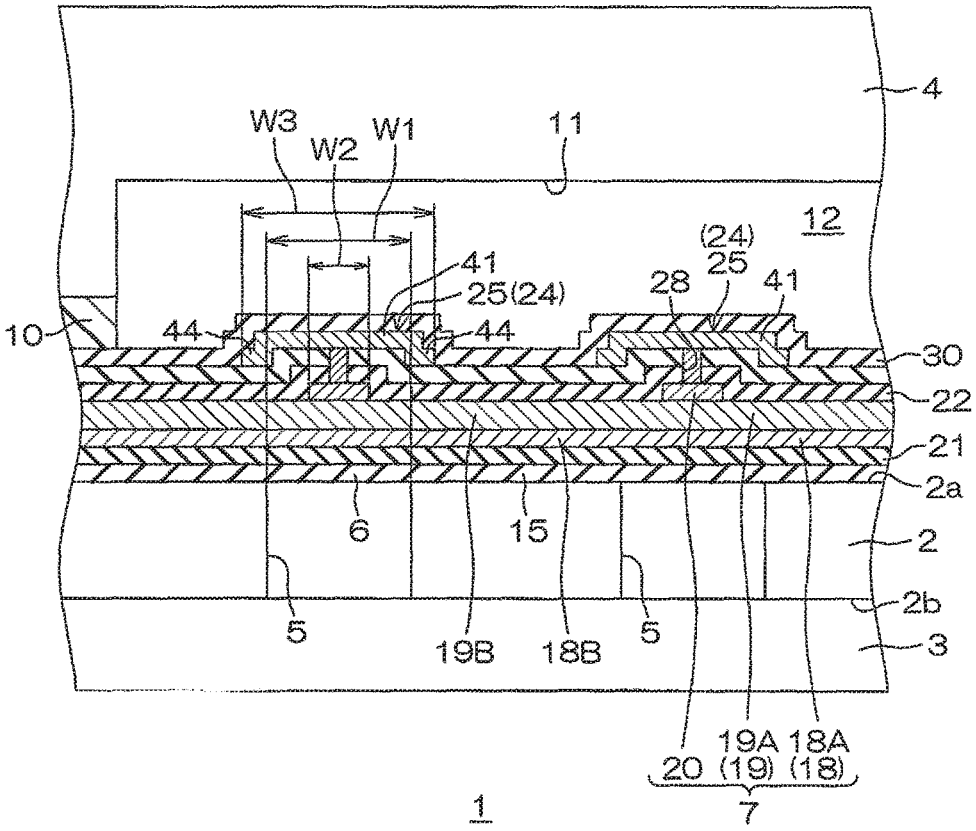
FIG. 3 is a cross-sectional view of the inkjet apparatus (a cross-sectional view of the line in FIG. 1).
Figure 4:
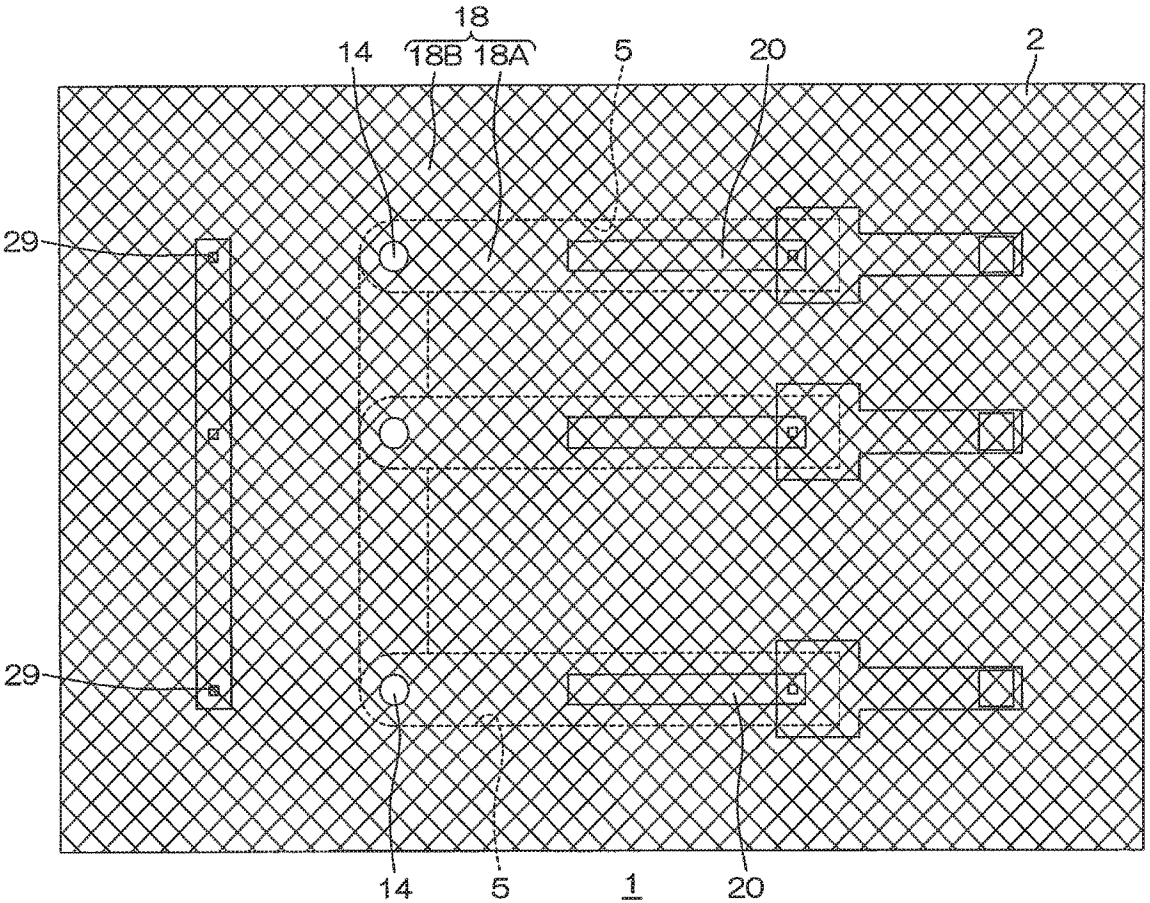
FIG. 4 is a schematic plan view showing a pattern example for a lower electrode of the inkjet apparatus.
Figure 5:
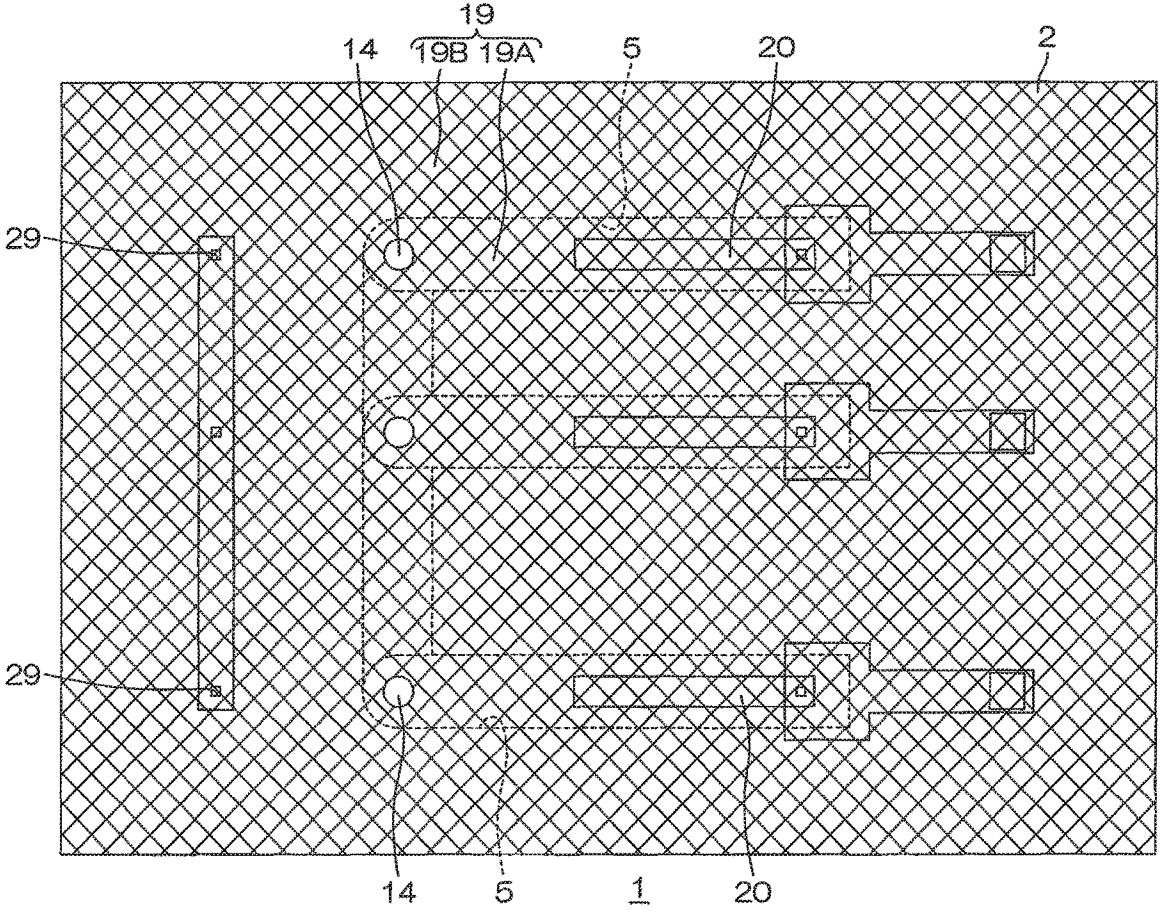
FIG. 5 is a schematic plan view showing a pattern example for a piezoelectric film of the inkjet apparatus.
Figure 6:
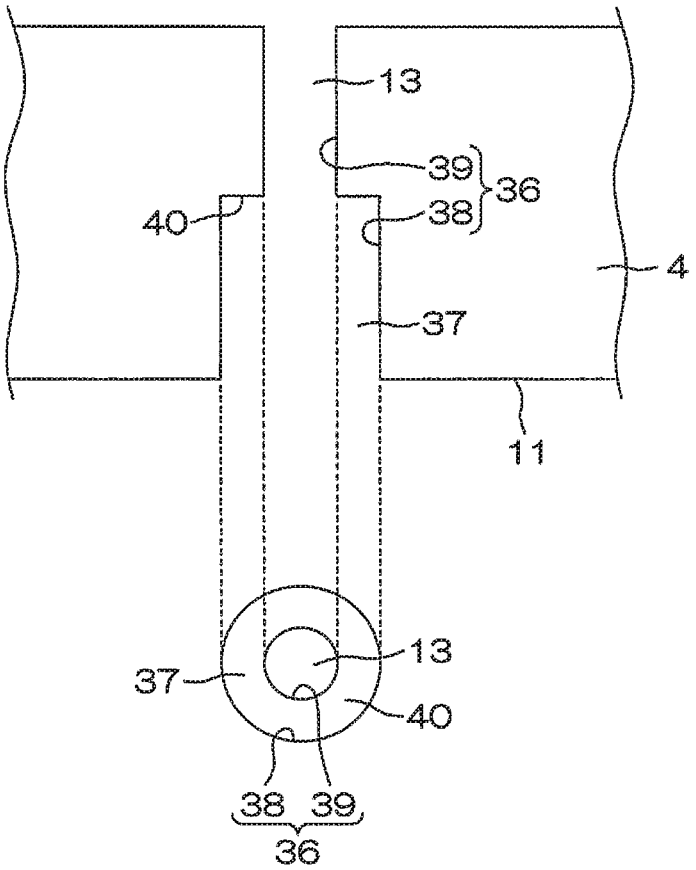
FIG. 6 is a schematic cross-sectional view showing an ink feed passage formed on a protection substrate of the inkjet apparatus.

An embodiment of the present invention is described in detail herein below by referencing to the appended drawings. FIG. 1 is a schematic plan view for illustrating the structure of an inkjet apparatus 1 in one embodiment of the present invention. FIG. 2 is a cross-sectional view of the inkjet apparatus 1 (a cross-sectional view of the line II-II in FIG. 1). FIG. 3 is a cross-sectional view of the inkjet apparatus 1 (a cross-sectional view of the line in FIG. 1). FIG. 4 is a schematic plan view showing a pattern example for a lower electrode 18 of the inkjet apparatus 1. FIG. 5 is a schematic plan view showing a pattern example for a piezoelectric film 19 of the inkjet apparatus 1. FIG. 6 is a schematic cross-sectional view showing the main part of a protection substrate 4 of the inkjet apparatus 1. Further, FIG. 4 and FIG. 5 only show the required reference characters shown in FIG. 1 to FIG. 3 for convenience of explanation.

An inkjet apparatus 1 includes an actuator substrate 2, a nozzle substrate 3, and a protection substrate 4.

The actuator substrate 2 includes, for example, a silicon substrate, and partitions several cavities 5. A vibrating film 6 is supported on a front surface 2*a* of the actuator substrate 2. The vibrating film 6 forms the top wall of the cavity 5, and partitions the cavity 5. A piezoelectric element 7 is arranged on the vibrating film 6.

The nozzle substrate 3 is joined to a rear surface 2*b* of the actuator substrate 2. The nozzle substrate 3 includes, for example, a silicon substrate, and is stuck to the rear surface 2*b* of the actuator substrate 2. The nozzle substrate 3 partitions the cavity 5 together with the actuator substrate 2 and the vibrating film 6. The nozzle substrate 3 includes recess 8 facing the cavity 5. Ink discharge passage 9 is formed on the bottom surface of the recess 8. The ink discharge passage 9 goes through the nozzle substrate 3, and includes a discharge port on the side opposite to the cavity 5. Therefore, once the volume change of the cavity 5 occurs, ink stored in the cavity 5 is ejected from the discharge port through the ink discharge passage 9.

The protection substrate 4 includes, for example, a silicon substrate. The protection substrate 4 is arranged so as to cover the piezoelectric element 7, and is joined to the front surface 2*a* of the actuator substrate 2 by adhesives 10. The protection substrate 4 includes a storage recess 12 on an opposed face 11 facing the front surface 2*a* of the actuator substrate 2. The storage recess 12 stores several piezoelectric elements 7 respectively corresponding to several cavities 5.

An ink tank (not shown) for accumulating ink is arranged on the protection substrate 4. An ink feed passage 13 is formed so as to go through the protection substrate 4. The ink feed passage 13 of the protection substrate 4 communicates with the ink feed passage 14 of the actuator substrate 2. The ink feed passage 14 communicates with the cavity 5. Accordingly, ink in the ink tank which referred to as an ink feeding source, is supplied to the cavity 5 through the ink feed passage 13, 14.

The structure of the inkjet apparatus 1 is illustrated more specifically in the description below.

A vibrating film formation layer 15 is formed on the front surface 2*a* of the actuator substrate 2. In the vibrating film formation layer 15, a part forming the top wall of the cavity 5, namely a part partitioning the cavity 5, is the vibrating film 6. In the present specification, the term "partitioning the cavity 5" refers to defining walls or boundaries of the cavity 5.

In this embodiment, the cavity 5 is formed through the actuator substrate 2. On the actuator substrate 2, several cavities 5 extend in parallel with one another and are formed in stripe shapes. Further, for clarification, FIG. 1 shows three cavities. Several cavities 5 are formed at small intervals (for example, about between 30 μm to 350 μm) in their width direction with even intervals. In a plane view, each cavity 5 has a slenderized rectangular shape, which extends along the ink flow direction 16, is from the ink feed passage 14 toward the ink discharge passage 9. The ink feed passage 14 guiding ink from the ink tank 8 communicates with a common ink passage 17 in one end of the cavity 5. As shown in FIG. 1, several ink feed passages 14 are arranged along the common ink passage 17 with intervals. The ink feed passage 14 is formed through the vibrating film 6 (and all of the films on the vibrating film 6, such as a lower electrode 18 and a piezoelectric film 19 described below), then through the actuator substrate 2 into the common ink passage 17.

Each cavity 5 is partitioned by the vibrating film 6, the actuator substrate 2, and the nozzle substrate 3, and formed in an approximately rectangular parallelepiped shape in this embodiment. Or in other words, the vibrating film 6, actuator substrate 2, and nozzle substrate 3 define walls and boundaries of the cavity 5. The length of the cavity 5 may be, for example, about 800 μm, and its width W1 may be about 55 μm. In this embodiment, the ink discharge passage 9 of the nozzle substrate 3 is arranged near another end in the longitudinal direction of the cavity 5 (the opposite end of the ink feed passage 14).

The vibrating film 6 may be a mono-layer film of the silicon oxide film ($SiO_2$), or may be a laminated film ($SiN/SiO_2$) which laminates a silicon nitride film on a silicon oxide film. The cavity 5 does not necessarily pass through the actuator substrate 2. The cavity 5 may be a recess carved from the bottom surface side while a part close to the piezoelectric element 7 side is remained. In this instance, the remnant of the actuator substrate 2 forms a portion of the vibrating film 6. In this disclosure, the vibrating film 6 refers to the top wall partitioning the cavity 5 in the vibrating film formation layer 15.

The thickness of the vibrating film 6 is, for example, between 0.4 μm and 2 μm. In a case when the vibrating film 6 including the silicon oxide film, the thickness of the silicon oxide film may be about 1.2 μm. In another case when the vibrating film 6 including a laminated body formed by a silicon layer, a silicon oxide layer and a silicon nitride layer, the thickness of the silicon layer, the silicon oxide layer and the silicon nitride layer may be about 0.4 μm, respectively.

The piezoelectric element 7 is arranged on the vibrating film 6. A piezoelectric actuator (an example of the piezoelectric apparatus) is formed by the vibrating film 6 and the piezoelectric element 7. The piezoelectric element 7 include a lower electrode 18 on the vibrating film formation layer 15, a piezoelectric film 19 on the lower electrode 18, and an upper electrode 20 on the piezoelectric film 19. In other words, the piezoelectric element 7 is formed by interposing the piezoelectric film 19 between the upper electrode 20 and the lower electrode 18.

The lower electrode 18 may include, for example, a two-layer structure (Pt/Ti) formed by laminating a Ti (Titanium) layer and a Pt (Platinum) layer successively from the vibrating film 6 side. In addition, the lower electrode 18 may include a mono-layer film such as an Au (gold) film, Cr (Chrome) layer, Ni (Nickel) layer, or the like. The thickness of the lower electrode 18 is, for example, ≤0.2 times of the thickness of the piezoelectric film 19, and may be about 0.2 μm specifically. As shown in FIG. 2 and FIG. 4, the lower electrode 18 is formed over nearly the whole region of the front surface 2*a* of the actuator substrate 2. In this way, several cavities 5 are covered by the common lower electrode 18. The lower electrode 18 includes a main electrode part 18A arranged above the cavity 5, and an extension 18B extending to the outer space of the cavity 5. The main electrode part 18A is in contact with the upper surface of the vibrating film 6. The ink feed passage 14 goes through the lower electrode 18. The lower electrode 18 surrounds the ink feed passage 14 communicating with the cavity 5, and forms a part of the inner face of the ink feed passage 14. In other words, the lower electrode 18 is exposed at the inner face of the ink feed passage 14.

For example, a PZT $PbZr_xTi_{1-x}O_3$: Lead Zirconate Titanate) film formed by a sol-gel method or the sputtering method may be applied as the piezoelectric film 19. The piezoelectric film 19 includes a sintered body of the metal oxide crystal. The thickness of the piezoelectric film 19 is preferably between 1 μm to 5 μm. The whole thickness of the vibrating film 6 is preferably set to equal to the thickness of the piezoelectric film 19, or around ⅔ of the thickness of the piezoelectric film 19. As shown in FIG. 2 and FIG. 5, the piezoelectric film 19 is formed over nearly the whole region of the front surface 2*a* of the actuator substrate 2, similarly to the lower electrode 18. In this way, several cavities 5 are covered by the common piezoelectric film 19. The piezoelectric film 19 includes a main part 19A arranged above the cavity 5, and an extension 19B extending to the outer space of the cavity 5. The main part 19A is in contact with the upper surface of the main electrode part 18A of the lower electrode 18. The ink feed passage 14 goes through the piezoelectric film 19. The piezoelectric film 19 surrounds the ink feed passage 14 communicating with the cavity 5, and forms a part of the inner face of the ink feed passage 14. In other words, the piezoelectric film 19 is exposed on the inner face of the ink feed passage 14.

As shown in FIG. 1, each upper electrode 20 is provided on one respective cavity 5, and formed as a band shape (rectangular shape) along each respective cavity 5, respectively in a plane view. Furthermore, the upper electrode 20 is entirely constrained in the inner space of each cavity 5. The upper electrode 20 may be a mono-layer film of platinum (Pt), or may be, for example, a laminated structure formed by laminating a conductive oxide film (such as $IrO_2$ (Iridium oxide) film) and a metal film (such as Ir (Iridium) film). The thickness of the upper electrode 20 is, for example, ≤0.2 times of thickness of the piezoelectric film 19, and may be about 0.2 μm specifically.

As other structures of the inkjet apparatus 1, a first hydrogen barrier film 21 and a second hydrogen barrier film 22 are formed. The bottom surface of the lower electrode 18 (the main electrode part 18A and the extension 18B) is covered with the first hydrogen barrier film 21. The front surface of the upper electrode 20 and the front surface of the extension 19B of the piezoelectric film 19 are covered with the second hydrogen barrier film 22. The first and the second hydrogen barrier film 21, 22, for example, include $Al_2O_3$ (Aluminum oxide). Thus, The characteristic deterioration of the piezoelectric film 19 caused by the hydrogen reduction can be prevented. The thickness of the first and the second hydrogen barrier film 21, 22 is, for example, about 80 nm.

An interlayer film 23 is laminated on the second hydrogen barrier film 22. The interlayer film 23 includes, for example, $SiO_2$. The thickness of the interlayer film 23 is, for example, about 500 nm.

A wiring film 24 is formed on the interlayer film 23. The wiring film 24 may include a material including Al (aluminum). The thickness of the wiring film 24 is, for example, about 1000 nm. The wiring film 24 includes an upper wiring 25, a lower wiring 26, and a dummy wiring 27.

One end of the upper wiring 25 is arranged above one end of the upper electrode 20. A through hole (contact hole) 28 continuously passing through the second hydrogen barrier film 22 and the interlayer film 23 is formed between the upper wiring 25 and the upper electrode 20. One end of the upper wiring 25 enters the through hole 28, and is connected to the upper electrode 20 within the through hole 28. In other words, the upper wiring 25 extends over the outer space of the cavity 5 across the outer edge of the cavity 5 from the upper side of the upper electrode 20.

In a plane view, the lower wiring 26 is arranged in the outer space of the cavity 5 without facing the cavity 5. In other words, the lower wiring 26 is opposite to the extension 18B of the lower electrode 18 in the outer space of the cavity 5. A through hole (contact hole) 29 continuously passing through the piezoelectric film 19, the second hydrogen barrier film 22, and the interlayer film 23 are formed between the lower wiring 26 and the extension 18B of the lower electrode 18. In this embodiment, each through hole 29 is formed on the extension line of the respective cavity 5. The lower wiring 26 enters several through holes 29, and is connected to the extension 18B of the lower electrode 18 in the through hole 29. The through hole 29 passes through the piezoelectric film 19 so that the contact of the lower wiring 26 to the lower electrode 18 is surrounded by the piezoelectric film 19 as shown in FIG. 5. The piezoelectric film 19 forms a part of the inner face of the through hole 29, and is contacted to the lower wiring 26 within the through hole 29.

The dummy wiring 27 is a wiring film which is not electrically connected to both the upper wiring 25 and the lower wiring 26, and electrically insulated from them. In this embodiment, the dummy wiring 27 is formed in a ring shape surrounding the ink feed passage 14 as shown in FIG. 1. More specifically, the dummy wiring 27 includes an inner peripheral edge, which is located at the position separated from the ink feed passage 14 with a fixed distance so that the dummy wiring 27 will not exposed at the inner face of the ink feed passage 14.

A passivation film 30 is formed to cover the wiring film 24. The passivation film 30 includes, for example, SiN (silicon nitride). The thickness of the passivation film 30, for example, is ≥0.5 times of thickness of the piezoelectric film 19, and may be about 850 nm specifically. Pad openings 31, 32 are formed in the passivation film 30 so that a part of the upper wiring 25 and the lower wiring 26 is exposed as the pads. In a plane view, the pad opening 31 is formed in the outer space of the cavity 5, for example, formed in the distal end part of the upper wiring 25 (the opposite end of the contact to the upper electrode 20). The pad opening 32, for example, is formed so as to cover several contacts (the through holes 29) of the lower wiring 26.

An opening 33 is formed on the second hydrogen barrier film 22, the interlayer film 23 and the passivation film 30. Within the opening 33, a part of the front surface of the upper electrode 20 is exposed. In this embodiment, as shown in FIG. 1, the peripheral edge of the upper electrode 20 is covered by the second hydrogen barrier film 22 so that a middle part of the upper electrode 20 is selectively exposed in the opening 33. The outer edge of the opening 33 in the film which is not connected to the upper electrode 20 (in this embodiment, the interlayer film 23 and the passivation film 30) may be set in the outer space of the upper electrode 20 as shown in FIG. 2.

Through holes 34, 35 are formed on the protection substrate 4 so as to expose the pad area on the actuator substrate 2, which includes the pad opening 31 and the pad opening 32.

The piezoelectric element 7 is formed at a position opposite to the cavity 5 and sandwiching the vibrating film 6. In other words, the piezoelectric element 7 is formed in contact with a surface of the vibrating film 6 opposite to the cavity 5. The vibrating film formation layer 15 is formed on the actuator substrate 2. The vibrating film 6 is supported by the peripheral part of the cavity 5 in the vibrating film formation layer 15. Thus, the vibrating film 6 is supported by the actuator substrate 2. The vibrating film 6 has flexibility, which is deformable in a direction opposite to the cavity 5 (i.e., the thickness direction of the vibrating film 6).

Thus, once a driving voltage is applied to the piezoelectric element 7 from a driving IC (Integrated Circuit) (not shown), the piezoelectric film 19 deforms due to the inverse piezoelectric effect. In this way, the vibrating film 6 deforms together with the piezoelectric element 7; thereby, the volume change of the cavity 5 occurs, and ink in the cavity 5 is pressurized. The pressurized ink goes through the ink discharge passage 9, and discharges from the discharge port as a fine liquid drop.

The following description further illustrates the structure of the inkjet apparatus 1.

(1) The Internal Stress of the Vibrating Film 6 and the Piezoelectric Film 19

In this embodiment, the vibrating film 6 has the compressive stress, and the piezoelectric film 19 has the tensile stress. For example, the compressive stress of the vibrating film 6 is between −300 MPa and −100 MPa; the tensile stress of the piezoelectric film 19 is between 100 MPa and 300 MPa. In this way, an absolute value of an average stress of the vibrating film 6 and the piezoelectric film 19 is ≤100 MPa. The average stress can be provided by setting the tensile stress of the piezoelectric film 19 to a positive value, setting the compressive stress of the vibrating film 6 to a negative value, and calculating a mean value of the positive and negative values.

Furthermore, considering several upper layer films including the piezoelectric film 19 (such as the first hydrogen barrier film 21, the piezoelectric film 19, the second hydrogen barrier film 22, the interlayer film 23, and the passivation film 30), in which the upper layer films are arranged higher than the vibrating film 6 as viewed from the actuator substrate 2, an absolute value of an average stress of the upper layer films and the vibrating film 6, for example, may be ≤50 MPa.

(2) A Carved Part 37 of the Ink Feed Passage 13

As shown in FIG. 2 and FIG. 6, a through hole 36 forming the ink feed passage 13 is formed in the protection substrate 4. Furthermore, a carved part 37 communicating with the through hole 36 is formed in the opposed face 11 of the protection substrate 4. The carved part 37 surrounds the through hole 36 and forms a wide part in an end of the through hole 36. In this embodiment, the through hole 36 is formed in a circle shape in a plane view; the carved part 37 is similarly formed in a circle shape which is concentric with the through hole 36 and has a diameter larger than that of the through hole 36. Thus, by the carved part 37, the through hole 36 has a big diameter part 38 and a small diameter part 39 successively from the opposed face 11 of the protection substrate 4. The opening diameter of the through hole 36 in the big diameter part 38 is larger than the opening diameter of the small diameter part 39.

The small diameter part 39 and the big diameter part 38 are connected through a step surface 40 arranged at the middle of the thickness direction of the protection substrate 4. The step surface 40 extends along the direction crossing with the ink flow direction (longitudinal direction) of the through hole 36, and is arranged nearly at the center of the thickness direction of the protection substrate 4. In this way, the through hole 36 is formed in a funnel shape narrowed from the opposed face 11 to its opposite side face in a section view; also, as shown in FIG. 6, the step surface 40 is formed in a ring shape to surround the small diameter part 38 as viewed from a normal direction of the opposed face 11 of the protection substrate 4.

(3) The Difference Between Opening Diameters of the Through Holes 34~36 in the Protection Substrate 4

Opening diameters of the through holes 34~36 formed on the protection substrate 4 are different from each other. For example, once the diameter D1 of the through hole 36 serving as the ink feed passage 13 is defined as a reference, the diameter D2 of the through hole 34 and the diameter D3 of the through hole 35 are larger than the diameter D1. Further, in FIG. 2, the diameter of the small diameter part 39 of the through hole 36 is defined as the diameter D1 for convenience of explanation, even if the diameter D1 is defined as the diameter of the big diameter part 38, the relationship of the diameter D1>the diameter D2, D3 is maintained.

In this embodiment, the thickness of the protection substrate 4 is between 200 μm and 500 μm, and diameter D1 of the through hole 36 is between 30 μm to 50 μm. On the other hand, the diameter D2 of the through hole 34 is between 300 μm to 1500 μm, and the diameter D3 of the through hole 35 is between 300 μm to 1500 μm. As a result, an aspect ratio of the through hole 36 (the opening depth (the thickness of the protection substrate 4)/opening diameter) is larger than an aspect ratio of the through holes 34 and 35. For example, the aspect ratio of the through hole 36 is ≥10 times of the aspect ratio of the through holes 34 and 35.

(4) A Total Width of the Upper Wiring 25 is Larger than the Width of the Upper Electrode 20

As shown in FIG. 1 and FIG. 3, the upper wiring 25 has the total width which is larger than the width W2 of the upper electrode 20. In a case when the upper wiring 25 includes one wiring film as shown in FIG. 1, the total width is the width of the upper wiring 25 itself.

The upper wiring 25 integrally includes a first region 41 across a boundary region 43 of a movable part and a non-movable part of the inkjet apparatus 1 (i.e., the outer edge of the cavity 5), and a second region 42 laid in the outer space of the cavity 5. In this embodiment, the first region 41 and the second region 42 have widths W3, W4 which are larger than the width W2 of the upper electrode 20. On the other hand, the width W3 of the first region 41 is larger than the width W1 of the cavity 5; however the width W4 of the second region 42 is smaller than the width W1 of the cavity 5. In other words, in the structure shown in FIG. 1, the upper wiring 25 includes a wide part in the region across the boundary region 43, and includes a narrow part in the outer space of the cavity 5. The width W3 of the first region 41 of the upper wiring 25 is, for example, between 75 μm to 85 μm; the width W2 of the second region 42 of the upper wiring 25 is, for example, between 10 μm to 25 μm.

In addition, as shown in FIG. 3, since the upper electrode 20 is constrained in the inner space of the cavity 5, steps are formed on both sides of the upper electrode 20 in the width direction due to the thickness of the upper electrode 20. Thus, by covering the steps, the upper wiring 25 includes leg sections 44 which are formed to be hooked on the steps in the outer space of the cavity 5.

Figure 7A:
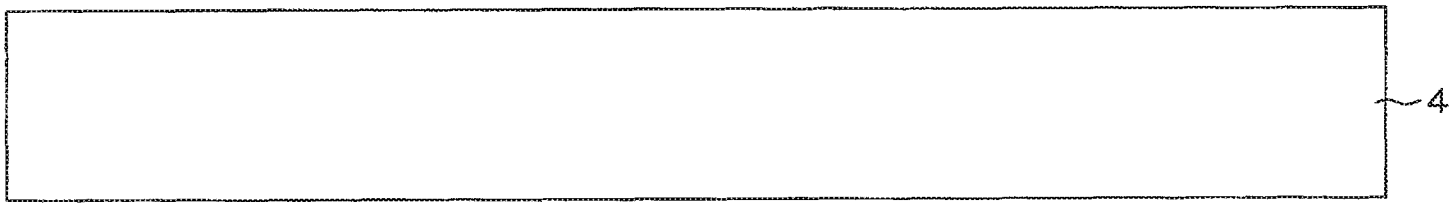
FIG. 7A is a figure illustrating a manufacturing process of the inkjet apparatus.
Figure 7B:
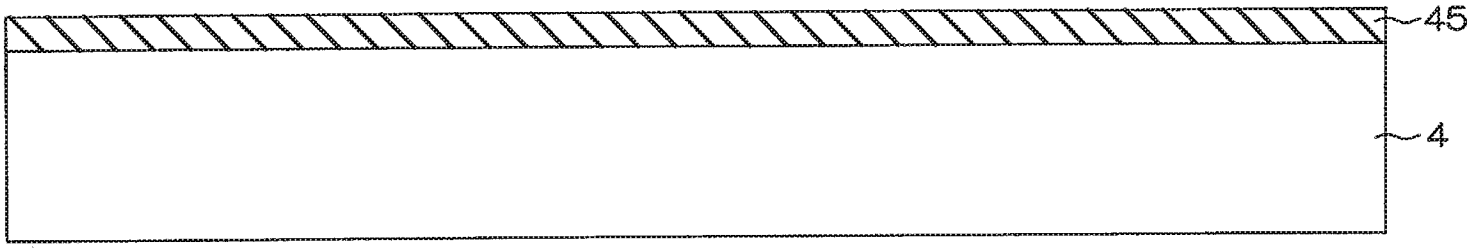
FIG. 7B is a figure illustrating a manufacturing process of the inkjet apparatus.
Figure 7C:
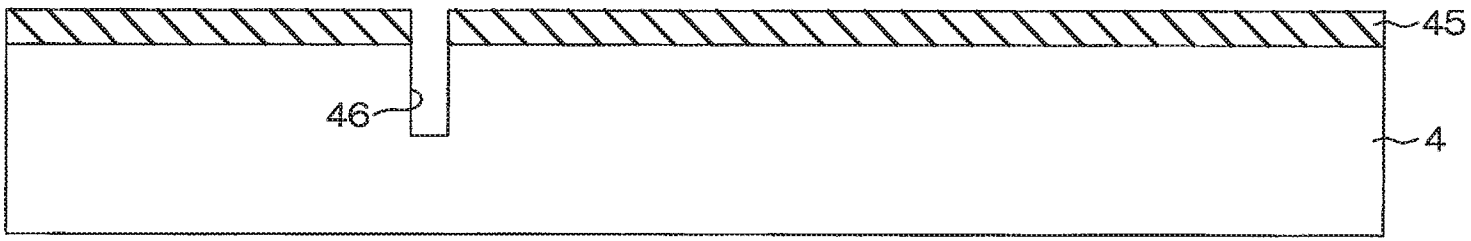
FIG. 7C is a figure illustrating a manufacturing process of the inkjet apparatus.
Figure 7D:
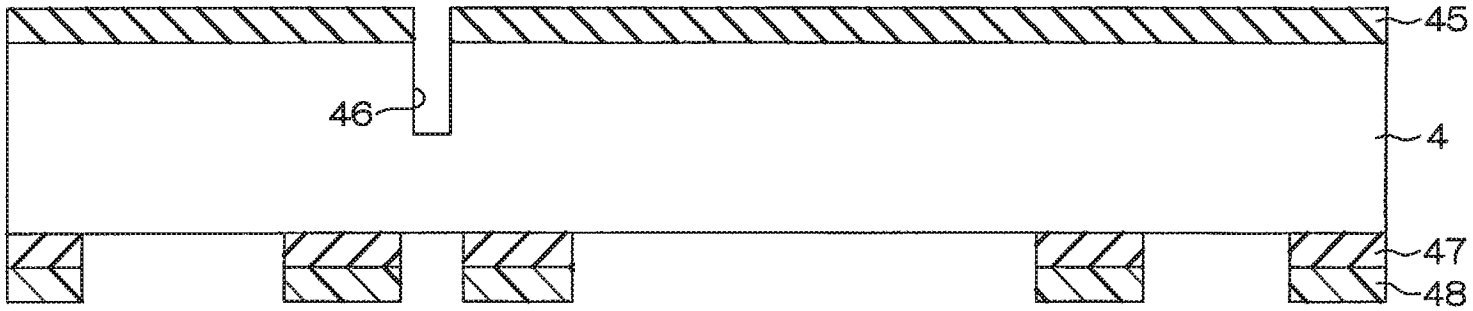
FIG. 7D is a figure illustrating a manufacturing process of the inkjet apparatus.
Figure 7E:
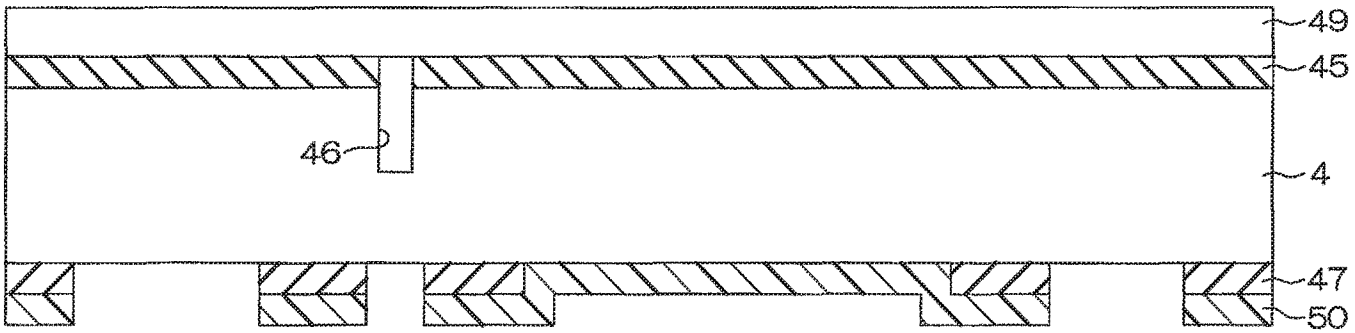
FIG. 7E is a figure illustrating a manufacturing process of the inkjet apparatus.
Figure 7F:
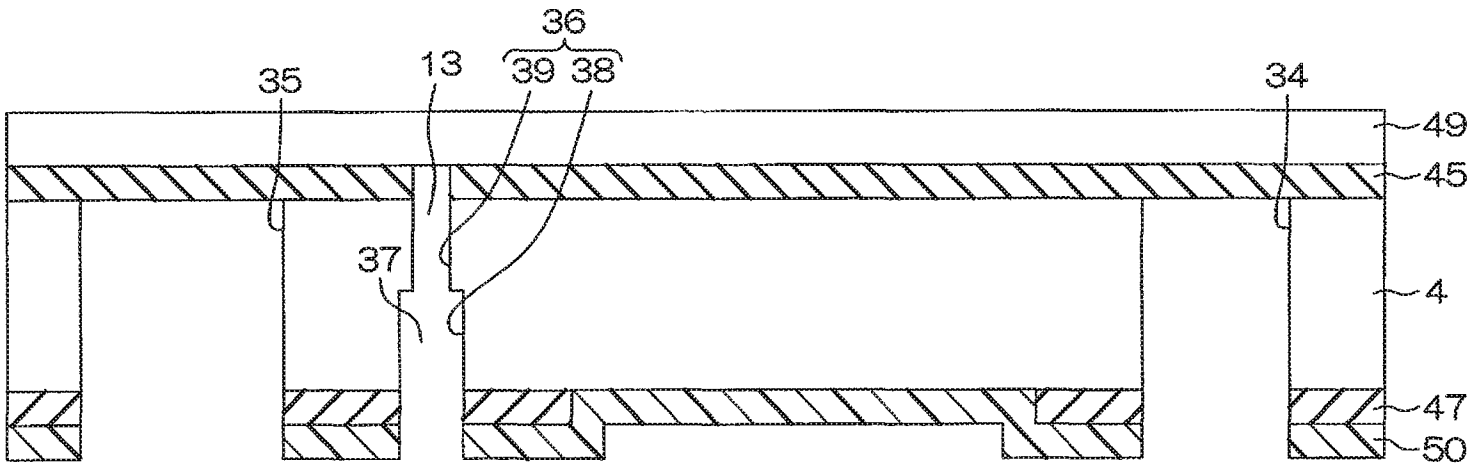
FIG. 7F is a figure illustrating a manufacturing process of the inkjet apparatus.
Figure 7G:
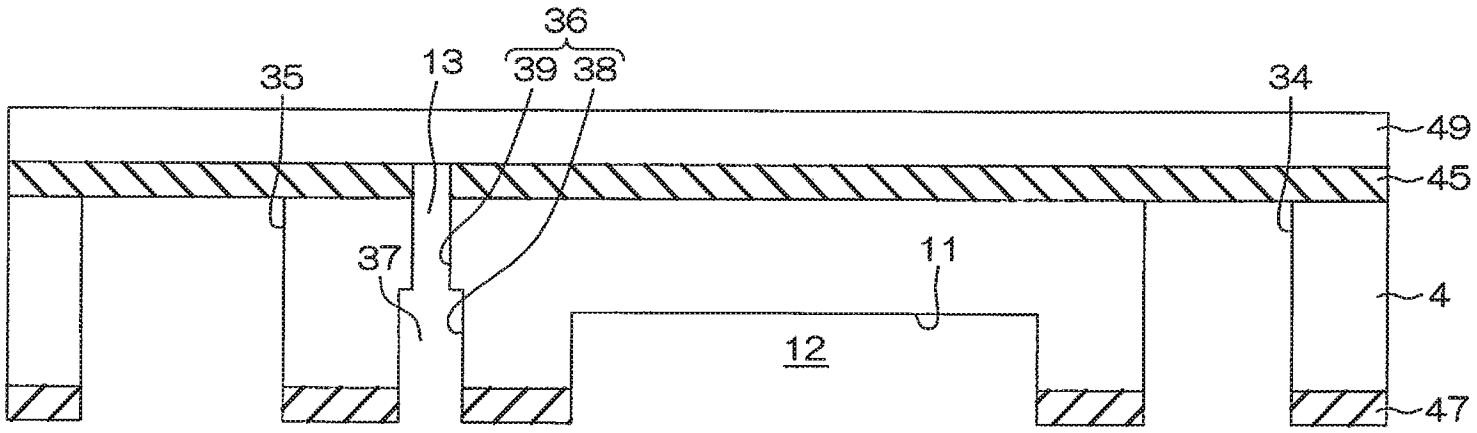
FIG. 7G is a figure illustrating a manufacturing process of the inkjet apparatus.
Figure 7H:
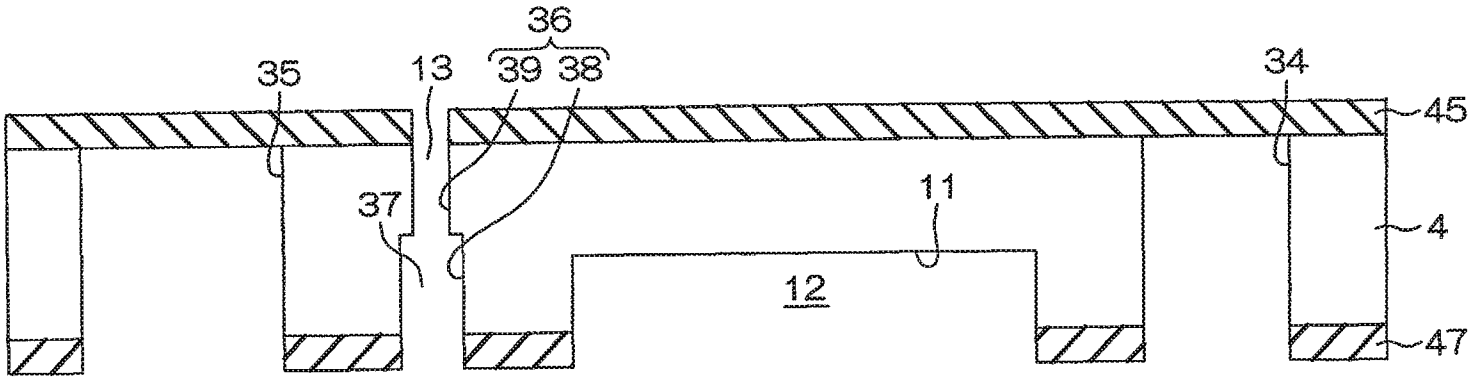
FIG. 7H is a figure illustrating a manufacturing process of the inkjet apparatus.
Figure 7I:
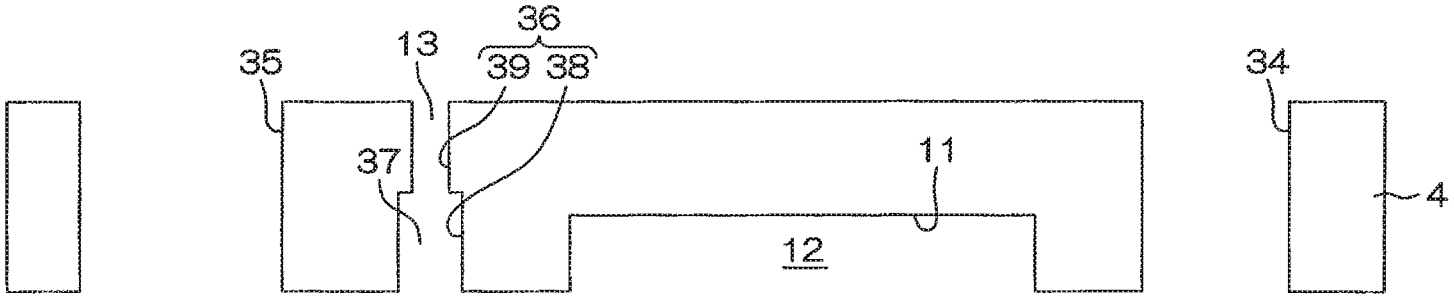
FIG. 7I is a figure illustrating a manufacturing process of the inkjet apparatus.
Figure 7J:
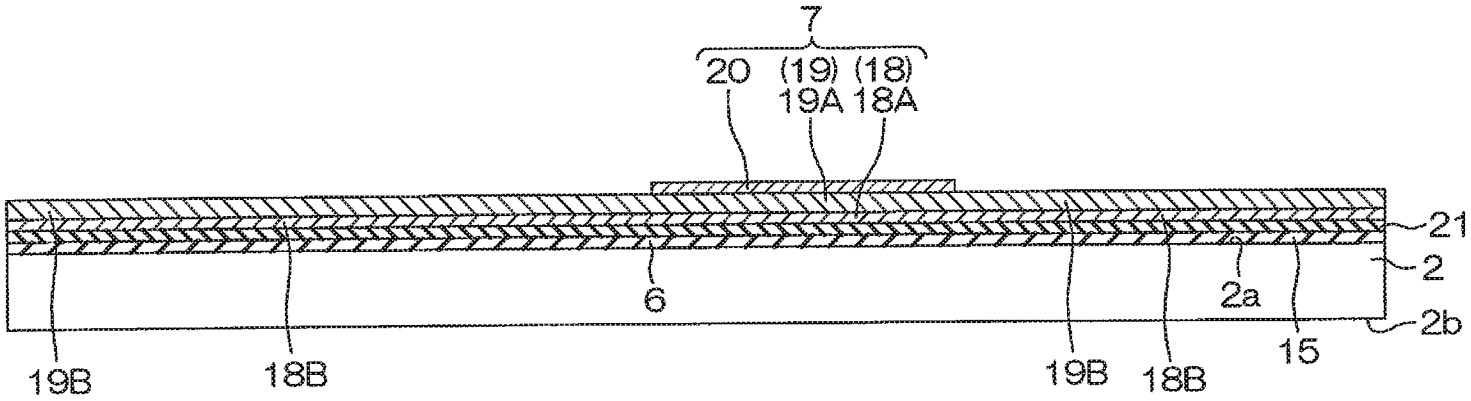
FIG. 7J is a figure illustrating a manufacturing process of the inkjet apparatus.
Figure 7K:
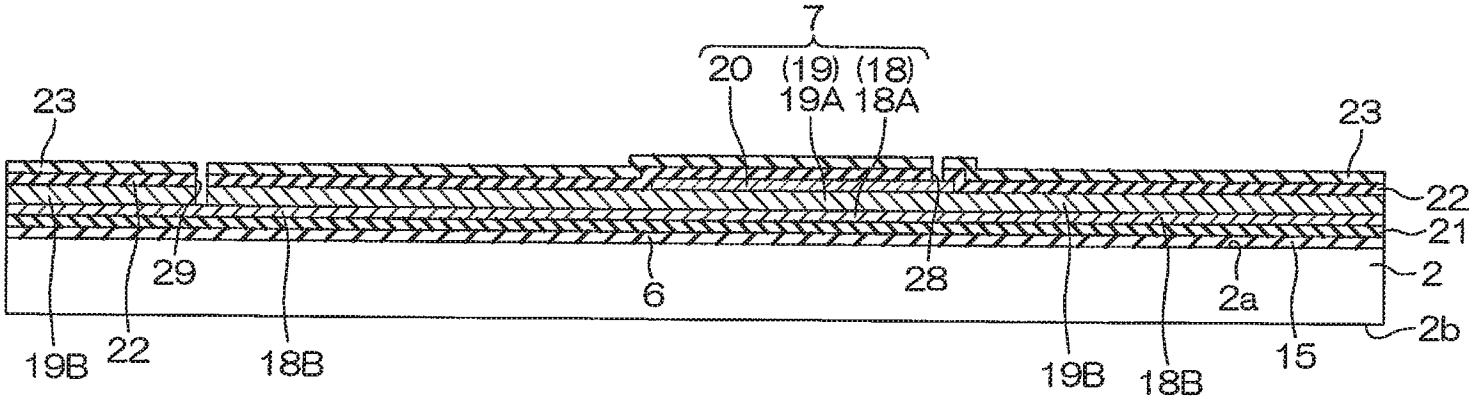
FIG. 7K is a figure illustrating a manufacturing process of the inkjet apparatus.
Figure 7L:
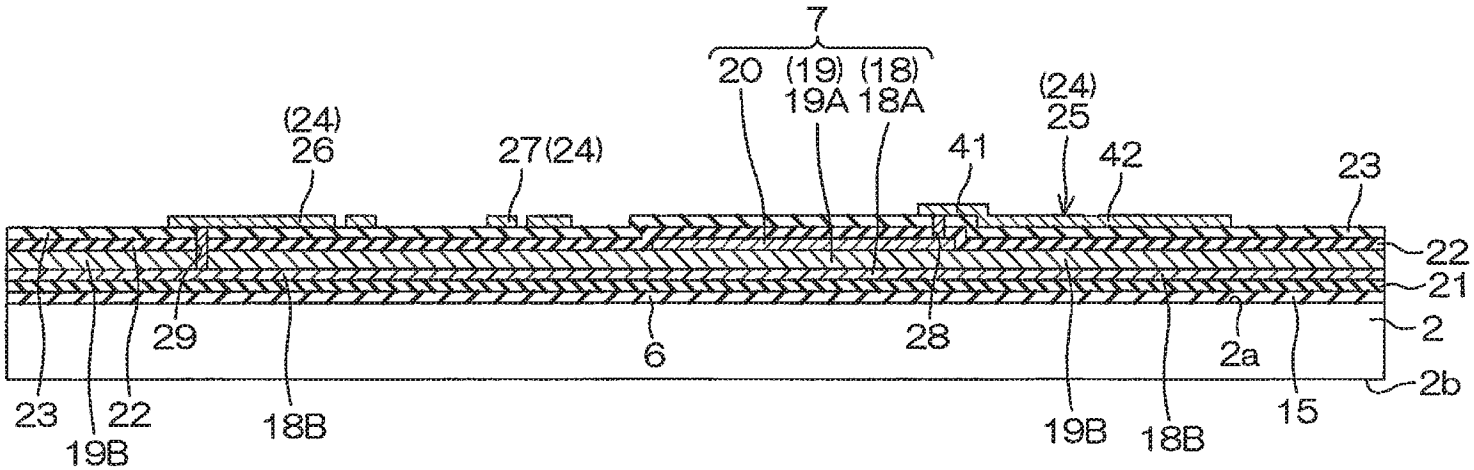
FIG. 7L is a figure illustrating a manufacturing process of the inkjet apparatus.
Figure 7M:
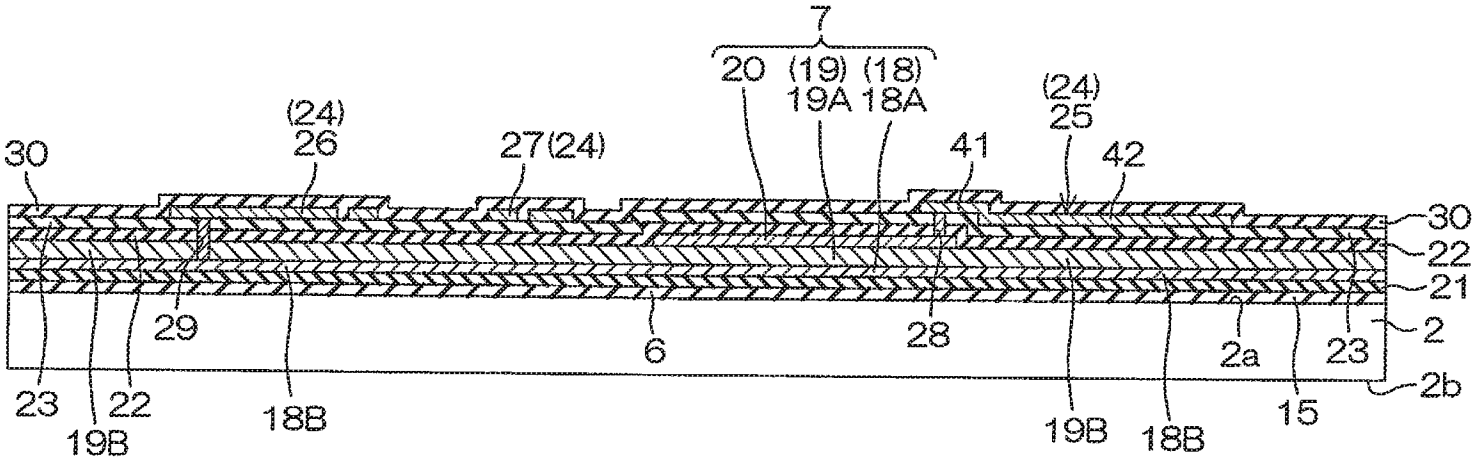
FIG. 7M is a figure illustrating a manufacturing process of the inkjet apparatus.
Figure 7N:
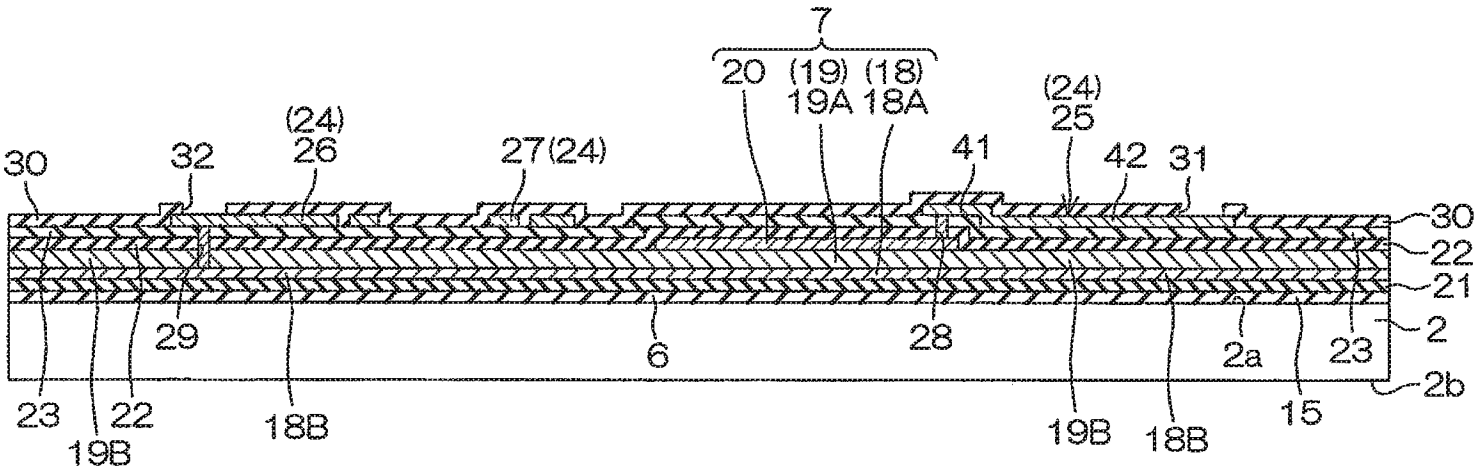
FIG. 7N is a figure illustrating a manufacturing process of the inkjet apparatus.
Figure 7O:
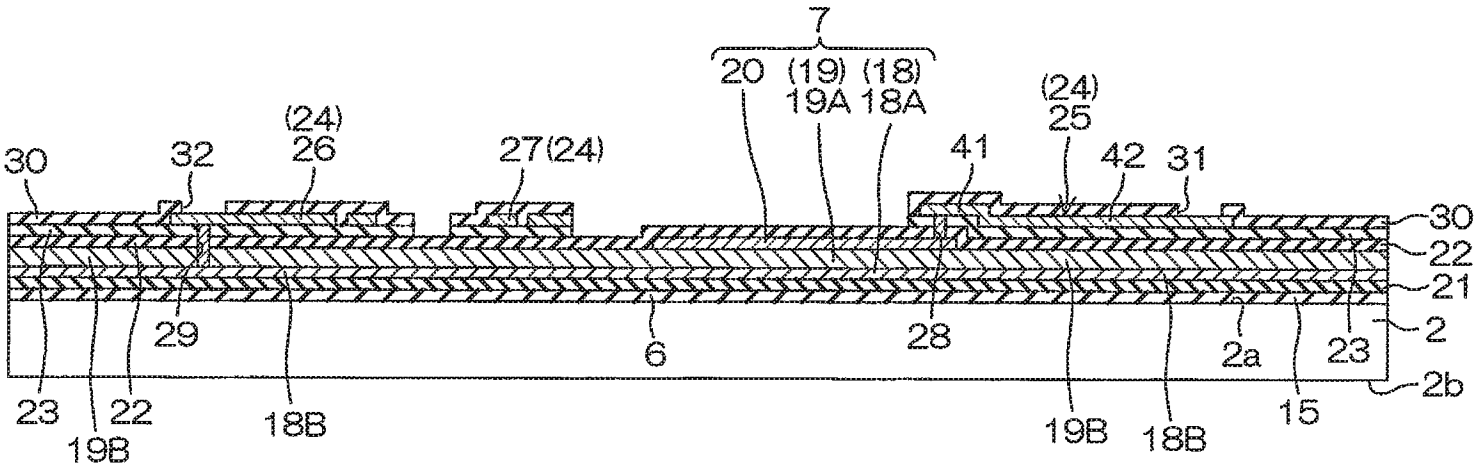
FIG. 7O is a figure illustrating a manufacturing process of the inkjet apparatus.
Figure 7P:
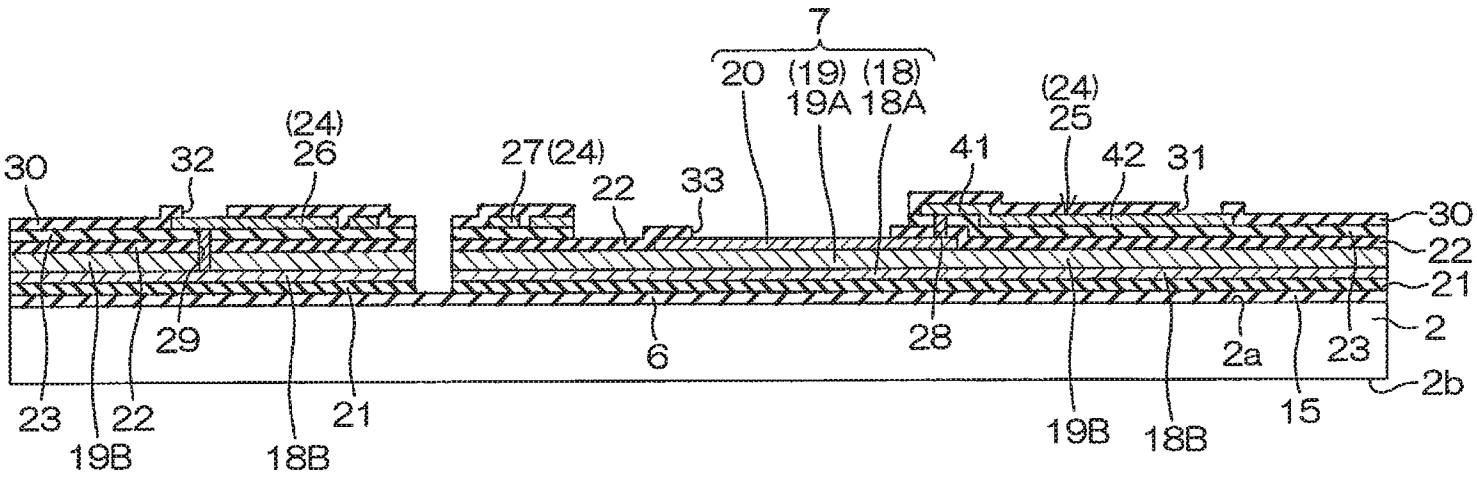
FIG. 7P is a figure illustrating a manufacturing process of the inkjet apparatus.
Figure 7Q:
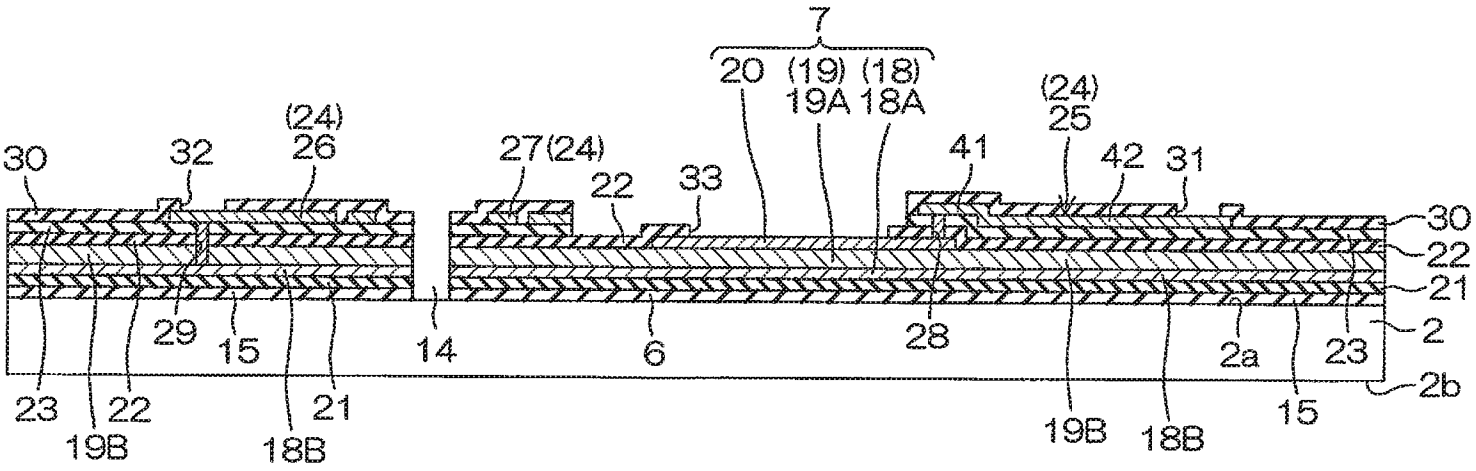
FIG. 7Q is a figure illustrating a manufacturing process of the inkjet apparatus.
Figure 7R:
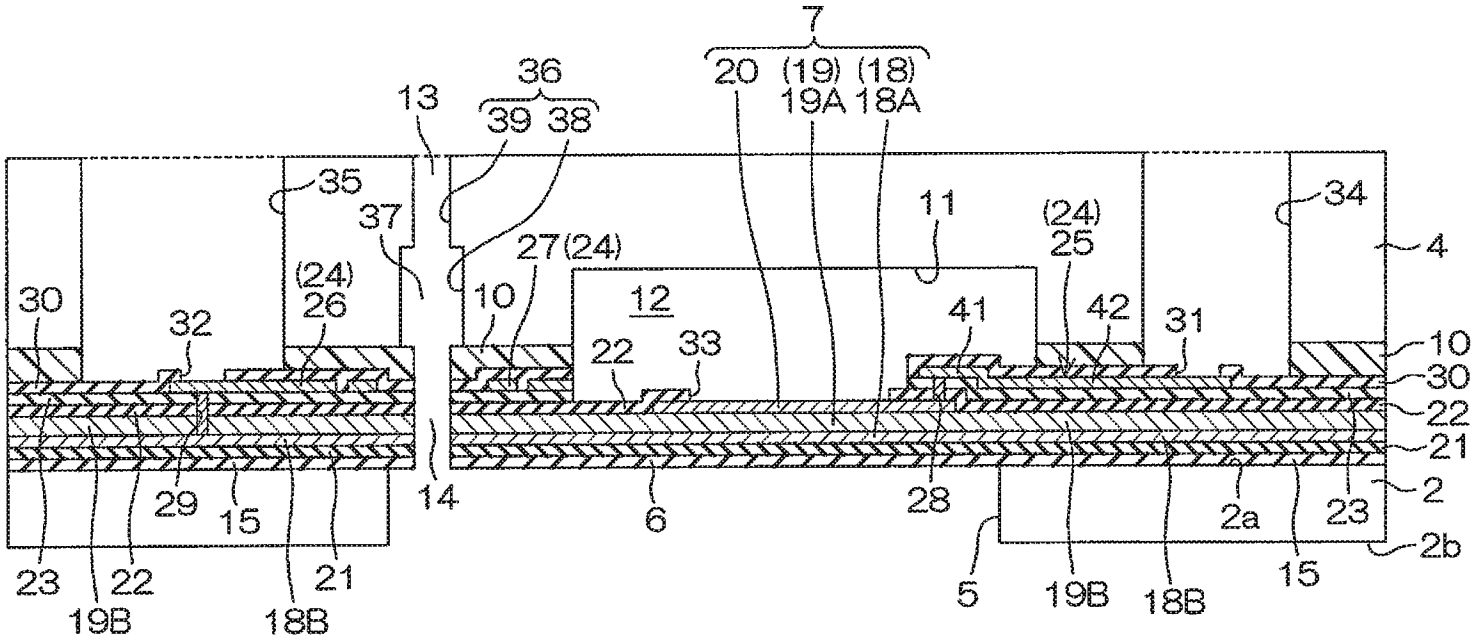
FIG. 7R is a figure illustrating a manufacturing process of the inkjet apparatus.
Figure 7S:
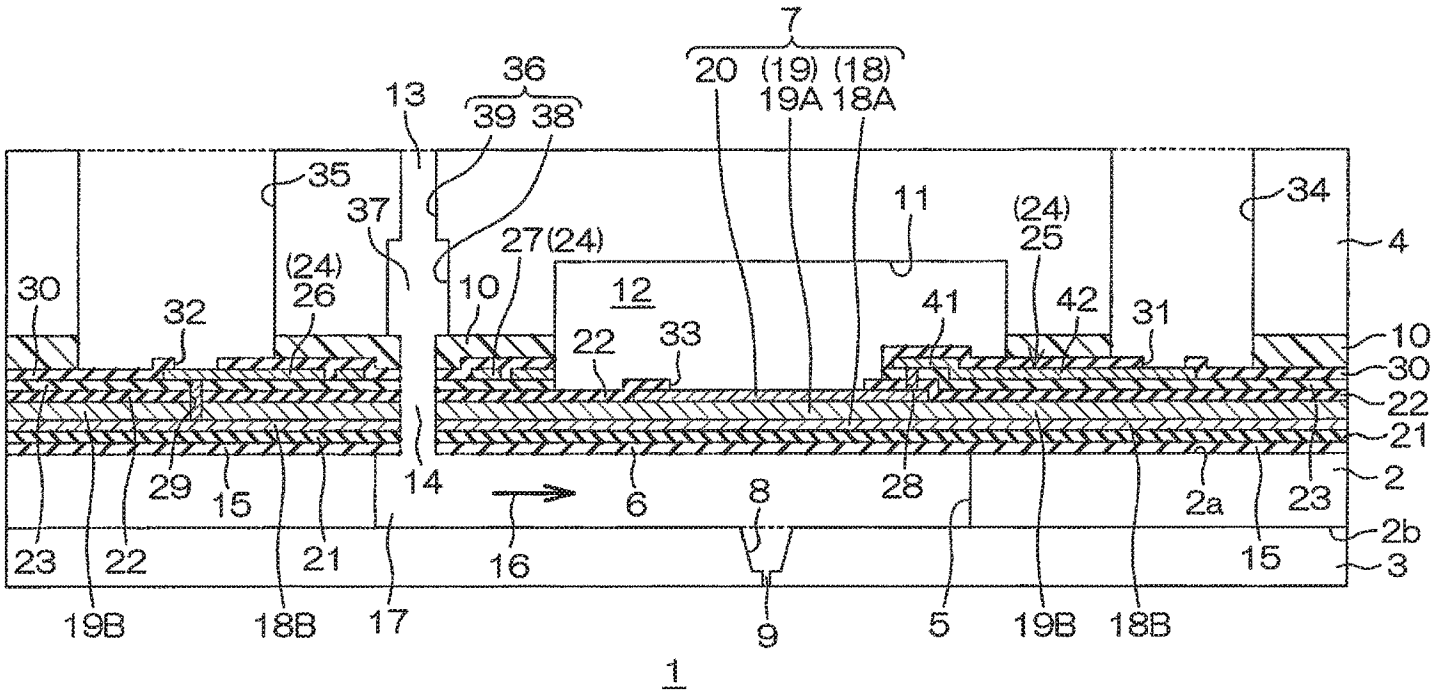
FIG. 7S is a figure illustrating a manufacturing process of the inkjet apparatus.

FIG. 7A~FIG. 7S are figures for illustrating a manufacturing process of the inkjet apparatus 1. FIG. 7A~FIG. 7S show the cross section of the inkjet apparatus 1 corresponding to FIG. 2.

The manufacturing process of the inkjet apparatus 1, roughly includes a preparation process of the protection substrate 4 shown in FIG. 7A~FIG. 7I, a preparation process of the actuator substrate 2 shown in FIG. 7J~FIG. 7Q, and other processes shown in FIG. 7R~FIG. 7S. In the following descriptions, the preparation process of the actuator substrate 2 is illustrated after illustrating the preparation process of the protection substrate 4; however, the mentioned processes may be applied in an opposite sequence.

First, as shown in FIG. 7A, a protection substrate 4 (a silicon substrate), for example, having a thickness of 400 μm is prepared; as shown in FIG. 7B, a thermal oxide film 45 (for example, having a thickness of 15000 Å) is formed on a front surface of the protection substrate 4.

Next, as shown in FIG. 7C, an opening is formed in an area forming a through hole 36 by patterning the thermal oxide film 45. Then, a hole 46 is formed up to the middle (nearly at the center) of the thickness direction of the protection substrate 4 by a dry etching method using the thermal oxide film 45 as the mask. The hole 46 is a part finally formed to be a small diameter part 39 of the through hole 36.

Next, as shown in FIG. 7D, an oxide film 47 is formed on the rear surface of the protection substrate 4 (the surface finally forming the opposed face 11), by using, for example, a plasma CVD (Chemical Vapor Deposition) method. Next, on the oxide film 47, a resist film 48 having the openings is formed in an area forming a storage recess 12 and through holes 34~36. Then, the oxide film 47 is selectively removed by a dry etching method using the resist film 48 as the mask. After that, the resist film 48 is removed.

Next, as shown in FIG. 7E, a support substrate 49 (for example, a silicon substrate having a thickness of 400 μm) is adhered to the front surface of the protection substrate 4. The protection substrate 4 is supported by the support substrate 49. Next, a resist film 50 is formed on the rear surface of the protection substrate 4 so as to cover the oxide film 47. Within the resist film 50, among the part buried in several openings of the oxide film 47, a part corresponding to the through holes 34~36 is selectively removed.

Next, as shown in FIG. 7F, the protection substrate 4 is selectively removed from the rear surface by a dry etching method using the resist film 50 and the oxide film 47 as the masks. The starting position of etching is the part corresponding to the through holes 34~36. By etching the hole 46 from its opposite side region, the through hole 36 (a carved part 37) is formed at the time point when the etching reaches the bottom of the hole 46. At this time, etching from the rear surface is carried out at a diameter of the big diameter part 38 of the through hole 36. However, in an area other than the through hole 36, etching is performed on the protection substrate 4 with a diameter larger than that to etch the through hole 36; thereby, the through holes 34 and 35 from the rear surface to the front surface of the protection substrate 4 at once, are formed simultaneously with the penetration of the hole 46. After that, the resist film 50 is removed.

Next, as shown in FIG. 7G, the storage recess 12 is formed by selectively removing the protection substrate 4 from the rear surface.

Next, as shown in FIG. 7H, the support substrate 49 is detached.

Next, as shown in FIG. 7I, the oxide films 45 and 47 covering the front and the rear surface of the protection substrate 4 are removed. Thus, the protection substrate 4 attached to the actuator substrate 2 is prepared.

Meanwhile, the preparation process of an actuator substrate 2 is as provided below. First, as shown in FIG. 7J, the actuator substrate 2 (a silicon substrate) having, for example, a thickness of 625 μm is prepared, and a vibrating film formation layer 15 is formed on the front surface 2*a* of the actuator substrate 2. The vibrating film formation layer 15 is formed by, for example, a plasma CVD method.

Next, a first hydrogen barrier film 21 (for example, having a thickness of 80 nm) is formed on the vibrating film formation layer 15. The first hydrogen barrier film 21 is formed by, for example, a sputtering method. After the formation of the first hydrogen barrier film 21, a lower electrode 18, a piezoelectric film 19, and an upper electrode 20 are successively formed. The lower electrode 18 and the upper electrode 20 are formed by, for example, a sputtering method. The piezoelectric film 19 is formed by, for example, a sol-gel method, or may be formed by a sputtering method.

In the sol-gel method for forming the piezoelectric film 19, the piezoelectric film 19 is formed by processing a main calcination process. In the main calcination process, gelatinizing a coating film of the precursor solution including PZT to form a gelled film, and laminating one or several gelled films on the lower electrode 18, then processing a thermal treatment to calcine. The sol-gel method is usually performed under high-temperature conditions (for example, about 700° C. in the main calcination process). After that, the film is cooled. As the film is shrunk during the cooling, the piezoelectric film 19 has a tensile stress.

After that, the upper electrode 20 is selectively etched to form a final prescribed shape. Thus, a piezoelectric element 7 is formed.

Next, as shown in FIG. 7K, a second hydrogen barrier film 22 and an interlayer film 23 are successively formed so as to cover the piezoelectric element 7. Then, through holes 28, 29 are formed by continuously etching the interlayer film 23 and the second hydrogen barrier film 22.

Next, as shown in FIG. 7L, after the formation of a TiN film (for example, having a thickness of 50 nm) on the interlayer film 23, a wiring film 24 is formed by a sputtering method. After that, an upper wiring 25, a lower wiring 26 and a dummy wiring 27 are formed simultaneously by patterning the wiring film 24.

Next, as shown in FIG. 7M, a passivation film 30 covering the wiring film 24 is formed. The passivation film 30 is formed, for example, by a plasma CVD method.

Next, as shown in FIG. 7N, pad openings 31, 32 are formed by selectively etching the passivation film 30.

Next, as shown in FIG. 7O and FIG. 7P, after continuously etching the passivation film 30 and the interlayer film 23 on the upper electrode 20, the second hydrogen barrier film 22 is selectively etched. In this way, an opening 33 is formed.

Next, as shown in FIG. 7Q, several films on the actuator substrate 2 are continuously etched. In this way, an ink feed passage 14 passing through the piezoelectric film 19 and the lower electrode 18 (an extension 18B) is formed.

Next, as shown in FIG. 7R, adhesives 10 are applied to the opposed face 11 while directing the opposed face 11 of the protection substrate 4 upward. Then the protection substrate 4 is fixed on the actuator substrate 2 from the upper side so that an ink feed passage 13 coincides with the ink feed passage 14. Next, after thinning the actuator substrate 2 from the rear surface 2*b* by grinding (for example, 625 μm→100 μm), a cavity 5 is formed by selectively etching from the rear surface 2*b*.

After that, as shown in FIG. 7S, a nozzle substrate 3 is fixed on the rear surface 2*b* of the actuator substrate 2 so as to cover the cavity 5 of the actuator substrate 2. The inkjet apparatus 1 is provided via the processes described above.

<Operation and Effect>

(1) Operation and Effect About the Pattern of the Piezoelectric Film 19

In this embodiment, for example, as shown in FIG. 5, the piezoelectric film 19 is formed in approximately the whole region of the front surface 2*a* of the actuator substrate 2. A region for forming the piezoelectric film 19 is not constrained in the inner space of the cavity 5. The regions without forming the piezoelectric film 19 thereon are merely the ink feed passage 14 and the contacts (the through holes 29) of the lower wiring 26. In addition, the removing area can be formed by an etching during the formation of the ink feed passage 14 and the through hole 29 (FIG. 7K, FIG. 7P). Accordingly, the piezoelectric film 19 is not required to be patterned. Even the pattern of the piezoelectric film 19 is not over the whole region of the front surface 2*a* of the actuator substrate 2, if the pattern extends along a space covering the whole cavity 5; the size of the pattern is bigger and the high accuracy of etching is not required. Therefore, the piezoelectric film 19 can be processed (etched) easily during the patterning of the piezoelectric film 19. Thus, the yield of the inkjet apparatus 1 can be improved. Also, given that the peripheral edge of the piezoelectric film 19 is set at least in the outer space of the cavity 5 (i.e., the outer space of the movable part of the piezoelectric element 7), even if the peripheral edge of the piezoelectric film 19 is damaged by etching, the degradation in the withstand voltage of the piezoelectric element 7 caused by the damage can still be prevented.

Further, in this embodiment, although the piezoelectric film 19 is exposed on the side surface of the ink feed passage 14, a region for forming the ink feed passage 14 is not the movable part of the piezoelectric element 7. As a result, the exposure of the piezoelectric film 19 will not poorly affect the piezoelectric performance.

(2) Operation and Effect about the Internal Stress in the Vibrating Film 6 and the Piezoelectric Film 19

In this embodiment, since the piezoelectric film 19 has the tensile stress opposite in direction to the vibrating film 6, the compressive stress generated in the vibrating film 6 can be counterbalanced. In this way, as shown in FIG. 7R, when the etching is performed on the actuator substrate 2 to release the vibrating film 6, the tension applied on the vibrating film 6 can be brought close to zero. Accordingly, at the time of driving the piezoelectric element 7, the vibrating film 6 can be favorably displaced. Therefore, the extent of displacement necessary for ejecting ink can be provided. Further, the compressive stress of the vibrating film 6 can be easily adjusted by controlling the film formation conditions during the implementation of a plasma CVD method; the tensile stress of the piezoelectric film 19 can be easily adjusted by controlling the film formation conditions during the implementation of a sol-gel method and a sputtering method.

Also, in this embodiment, since a part of the upper electrode 20 of the passivation film 30 is removed, the stress possessed by the passivation film 30 has negligible impact on the tension of the vibrating film 6. Furthermore, since the first hydrogen barrier film 21, the second hydrogen barrier film 22, the interlayer film 23, the lower electrode 18 and the upper electrode 20 are considerably thinner than the piezoelectric film 19, even when having some internal stress, the stress (acting the same with the passivation film 30 in this embodiment) has negligible impact on the tension of the vibrating film 6.

(3) The Operation and Effect about the Carved Part 37

In this embodiment, since the carved part 37 is formed in the opposed face 11 of the protection substrate 4. As a result, even if the adhesives 10 flow from the circumference of the through hole 36 at the time of fixing the actuator substrate 2 on the protection substrate 4, all or a part of the adhesives 10 can still be caught by the carved part 37. In this way, the blockage of the adhesives 10 in the through hole 36 (the ink feed passage 13) of the protection substrate 4 can be suppressed or prevented. Thus, ink can be properly provided to the cavity 5.

Also, the carved part 37 is formed in a circle shape which is concentric with the through hole 36 and has a diameter larger than that of the through hole 36. In this way, only the circumference of the through hole 36 is needed for forming the carved part 37 so that the apparatus can be suppressed from being increased in size by forming the carved part 37.

(4) Operation and Effect about a Method for Forming the through Hole 36 (the Ink Feed Passage 13) of the Protection Substrate 4

In this embodiment, the through hole 36 is formed by, first forming the hole 46 on the front surface of the protection substrate 4 (FIG. 7C), then etching the protection substrate 4 from the rear surface to penetrate the hole 46 (FIG. 7F). In other words, to form the through hole 36, etching the protection substrate 4 from the front surface and the rear surface respectively, as compared with the case of etching from the front surface to the rear surface at once, the depth of single etching is shallower. For that reason, the average etching rate till the formation of the through hole 36 can be improved. As a result, etching time required for forming the through hole 36 can be shorten.

Also, In this embodiment, it is necessary to form the through holes 34~36 with the dimensions differing from each other on the protection substrate 4. In this instance, in the region for forming the through hole 36 with the relatively small etching size, the hole 46 is previously formed. Thus, in the process in FIG. 7F, if the substrate material is etched from the region for forming the through hole 36 on the rear surface of the protection substrate 4 with a thickness having reduced the depth of the hole 46 from the thickness of the protection substrate 4, the through hole 36 can be formed. Therefore, although etching rates differ between the region for forming the through hole 36 and the region for forming the through holes 34 and 35, the variation of the timings that the through holes 34~36 are formed in the respective region (i.e., a completion time of etching) is eliminated. Thus, the through holes 34~36 can be formed with approximately the same timing. As a result, the occurrence of over etching can be suppressed or prevented.

(5) Operation and Effect about the Shape of the through Hole 36 (the Ink Feed Passage 13) of the Protection Substrate 4

Unlike this embodiment, at the time of etching the protection substrate 4 from the side opposite to the hole 46, if the etching size is almost the same as the hole 46, due to the misalignment, or other errors, the step may be generated on the joint portion of the through hole 36 (at the middle part of the thickness direction of the protection substrate 4). As a result, the part which the diameter of the through hole 36 is smaller than the designed value may be generated. Accordingly, as shown in FIG. 6, the through hole 36 has the big diameter part 38 and the small diameter part 39. By setting the machining dimensions of the big diameter part 38 as the size in consideration of the extent of the misalignment, at least the diameter corresponding to the small diameter part 39 can be secured. For that reason, by forming the small diameter part 39 according to the designed value of the through hole 36, the through hole 36 with the diameter as designed can be provided.

(6) The Operation and Effect about the Pattern of the Upper Wiring 25

In this embodiment, as shown in FIG. 1 and FIG. 3, at least the width W3 of the first region 41 (the region across the boundary region 43 of the movable part and the non-movable part of the inkjet apparatus 1) on the upper wiring 25, is larger than the width W2 of the upper electrode 20. Therefore, even if a large stress is applied on a part of the boundary region 43 of the upper wiring 25 due to the displacement of the vibrating film 6, the disconnection of a wire can be prevented.

<Variations>

(1) A Variation of the Pattern of the Piezoelectric Film 19

Figure 8A:
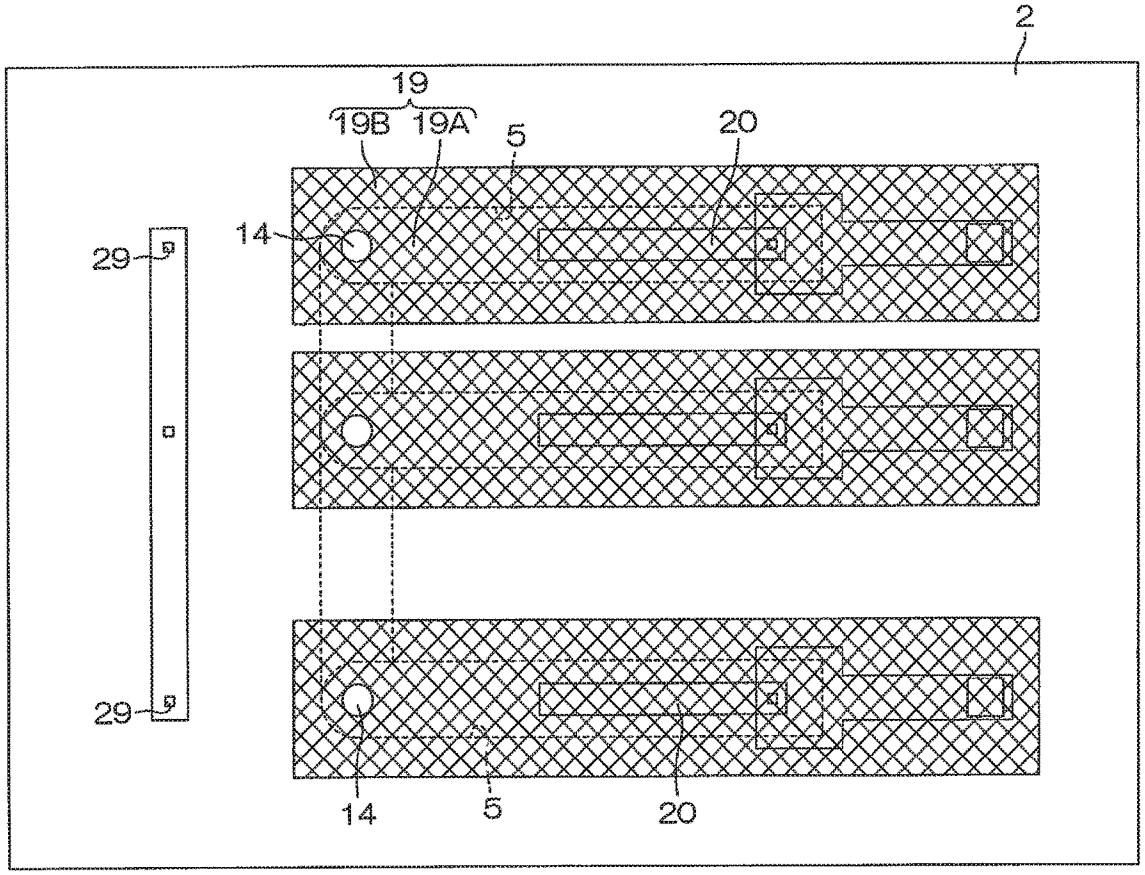
FIG. 8A shows a variation of the pattern of the piezoelectric film.
Figure 8B:
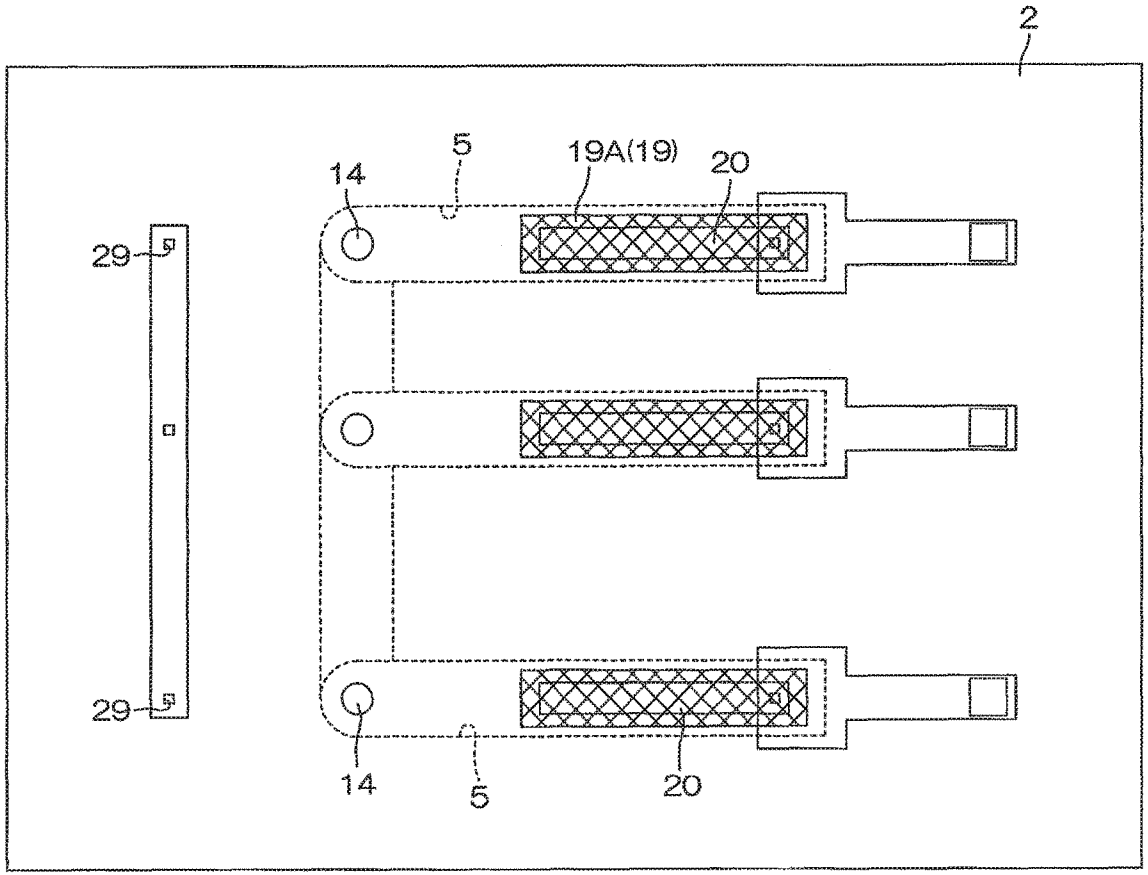
FIG. 8B shows a variation of the pattern of the piezoelectric film.

FIG. 8A and FIG. 8B show variations of the pattern of the piezoelectric film 19.

In the structure shown in FIG. 8A, the piezoelectric film 19 is a pattern extending along a space covering the whole cavity 5, and each piezoelectric film 19 is formed in correspondence with each respective cavity 5. The extension 19B of the respective piezoelectric film 19 is formed along the circumference of the cavity 5. According to such structure, the operation and effect described above under ⌈<Operation and effect> (1) Operation and effect about the pattern of the piezoelectric film 19⌋ can be achieved. Further, such piezoelectric film 19 is formed by, for example, patterning the piezoelectric film 19 in a predetermined shape after the formation of the piezoelectric film 19 in the process shown in FIG. 7J, and before the formation of the upper electrode 20.

On the other hand, in the structure shown in FIG. 8B, the piezoelectric film 19 only includes the main part 19A, and without the extension 19B. The plane size of the main part 19A of the piezoelectric film 19 is larger than that of the upper electrode 20, but the main part 19A of the piezoelectric film 19 is still constrained in the inner space of the cavity 5.

(2) A Variation of the Pattern of the Insulating Film Arranged on the Piezoelectric Film 19

Figure 9A:
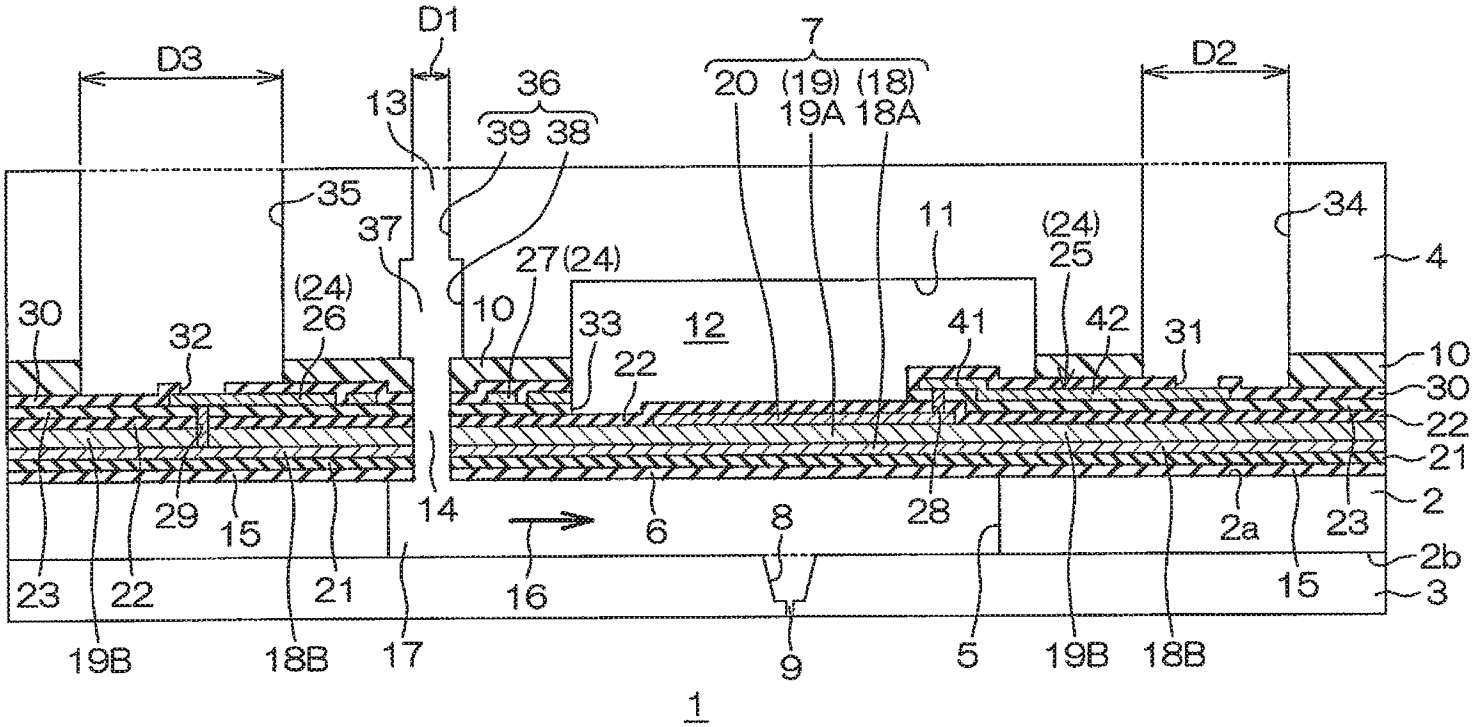
FIG. 9A shows a variation of the pattern of the insulating film on the piezoelectric film.
Figure 9B:
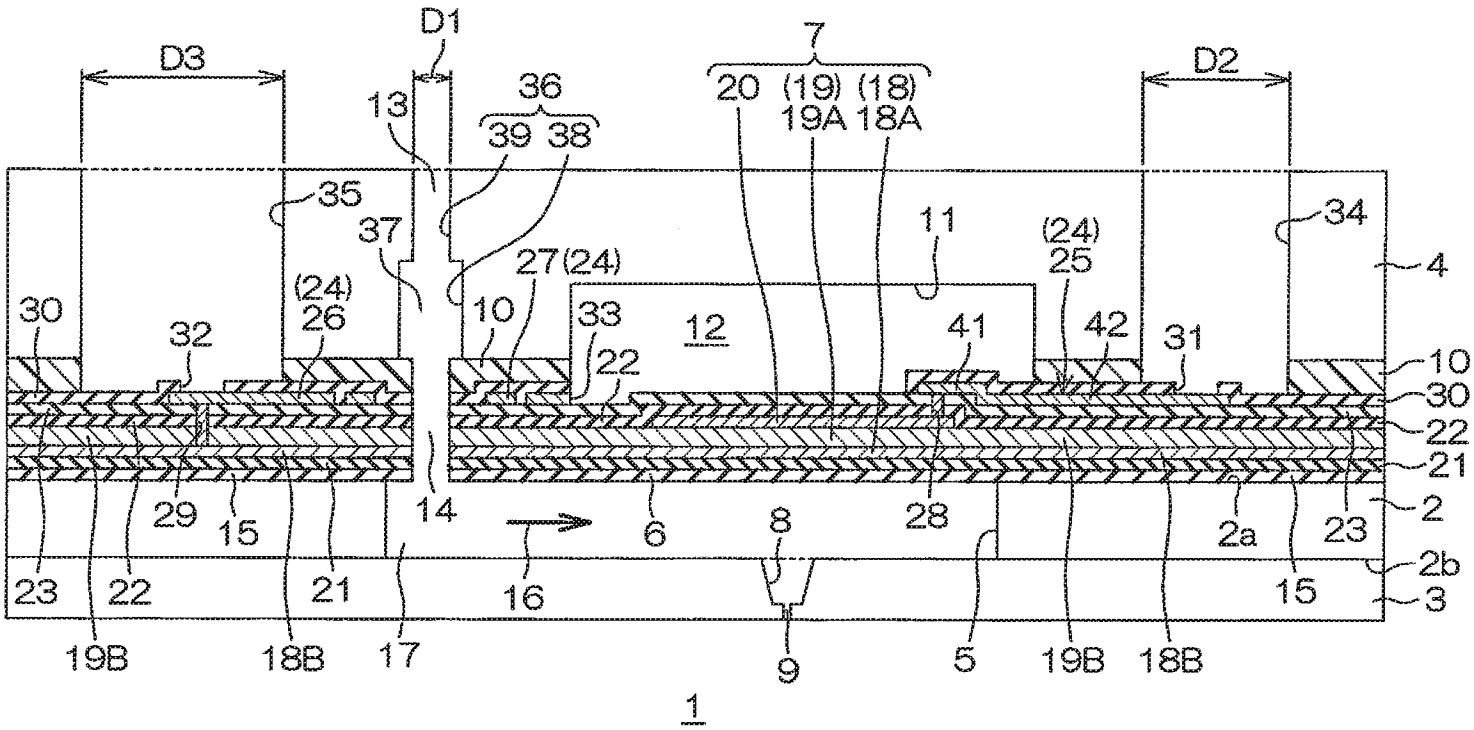
FIG. 9B shows a variation of the pattern of the insulating film on the piezoelectric film.
Figure 9C:
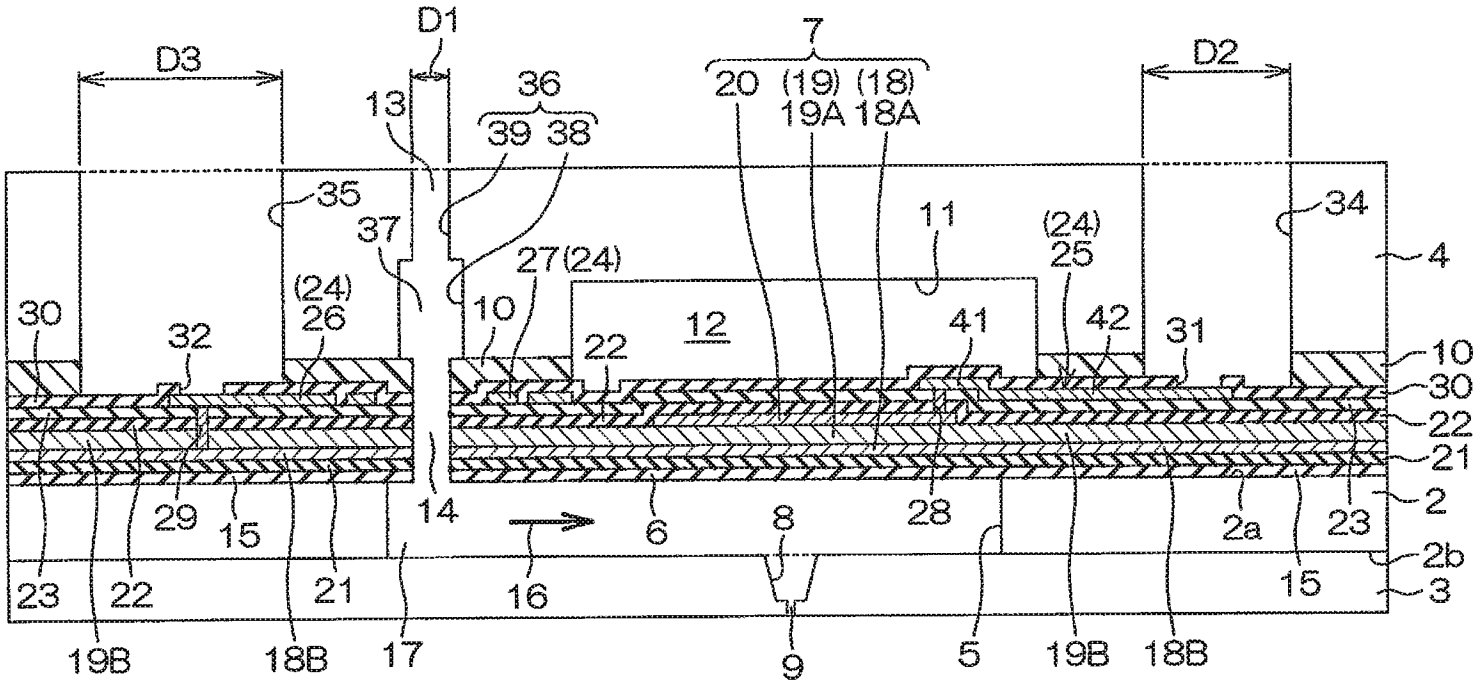
FIG. 9C shows a variation of the pattern of the insulating film on the piezoelectric film.

FIG. 9A~FIG. 9C show variations of the pattern of the insulating film arranged on the piezoelectric film 19, specifically, patterns of the second hydrogen barrier film 22, the interlayer film 23, and the passivation film 30.

In the structure shown in FIG. 9A, the opening 33 is not formed on the second hydrogen barrier film 22, and the front surface of the upper electrode 20 is covered by the second hydrogen barrier film 22. In the structure shown in FIG. 9B, the opening 33 is not formed on the interlayer film 23. Furthermore, in the structure shown in FIG. 9C, the opening 33 is not formed on the passivation film 30.

Particularly for the structure in FIG. 9C (in the case of the passivation film 30 remaining on the piezoelectric film 19), since the passivation film 30 is a relatively thick film, when adjusting the tension applied on the vibrating film 6, the internal stress of the passivation film 30 must be taken to consideration. In other words, the average stress including the passivation film 30, namely the absolute value of the average stress of the vibrating film 6, the piezoelectric film 19 and the passivation film 30, is preferably ≤50 MPa. Therefore, the operation and effect described above under ⌈<Operation and effect> (2) Operation and effect about the internal stress in the vibrating film 6 and the piezoelectric film 19⌋ can be greatly achieved.

(3) A Variation of the Shape of the Carved Part 37 of the Protection Substrate 4

FIG. 10A~FIG. 10K show variations of the shape of the ink feed passage 13 (especially the carved part 37) of the protection substrate 4.

Figure 10A:
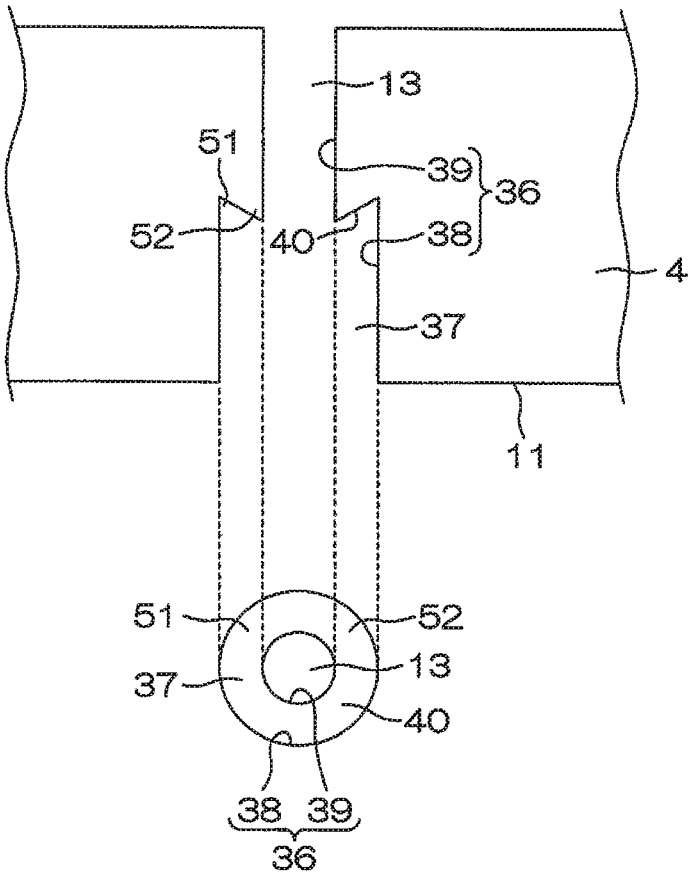
FIG. 10A shows a variation of the shape of an ink feed passage of the protection substrate.
Figure 10B:
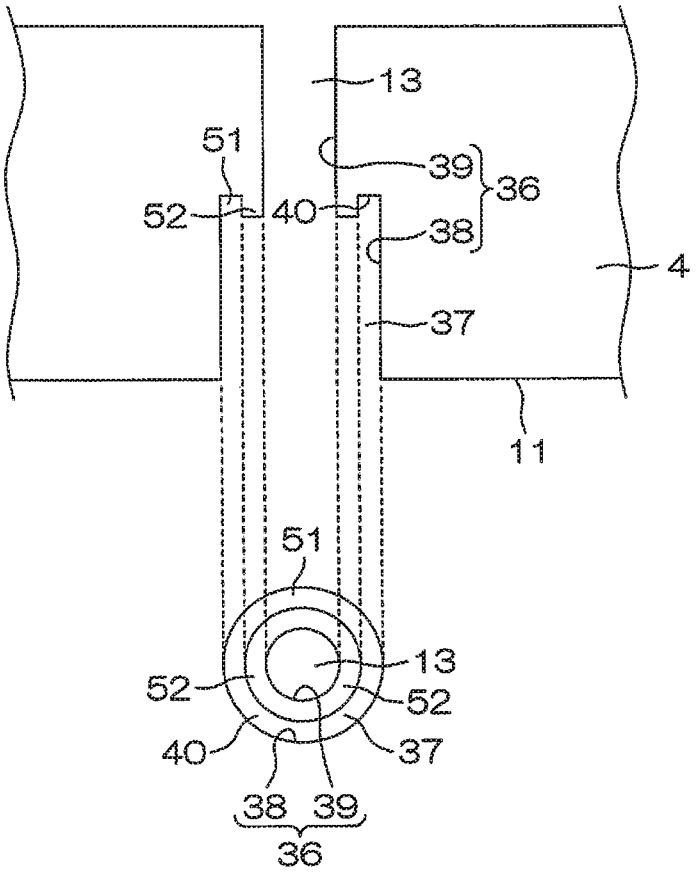
FIG. 10B shows a variation of the shape of an ink feed passage of the protection substrate.

In the structure shown in FIG. 10A, the carved part 37 includes a dam 52 which is arranged over the whole periphery of the carved part 37 so as to form a recessed groove 51 on the bottom of the carved part 37 in a section view. Particularly in the structure shown in FIG. 10Af, the dam 52 is formed in a shape with a pointed top in a section view. On the other hand, as shown by the structure in FIG. 10B, the dam 52 may be formed in a shape with a flat shape in a section view. In the structure shown in FIG. 10A and FIG. 10B, the adhesives flowed into the through hole 36 can be caught by the groove 51 so that the caught adhesives can be prevented from flowing out to the through hole 36.

Figure 10C:
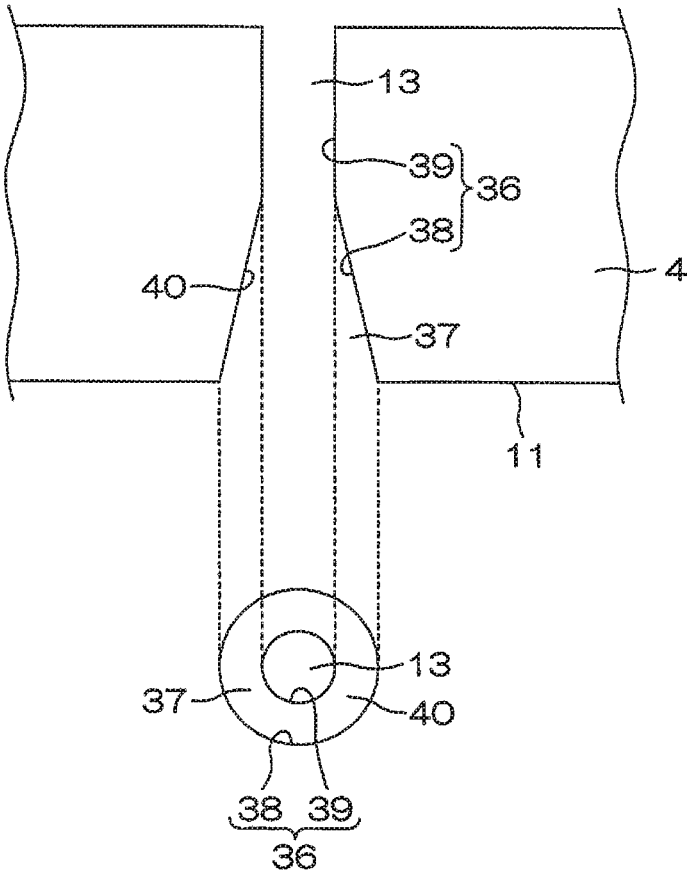
FIG. 10C shows a variation of the shape of an ink feed passage of the protection substrate.

In the structure shown in FIG. 10C, the carved part 37 (big diameter part 38) is formed in a taper shape. In other words, the big diameter part 38 has a diameter gradually narrower from the opposed face 11 of the protection substrate 4 toward an opposite side.

Figure 10D:
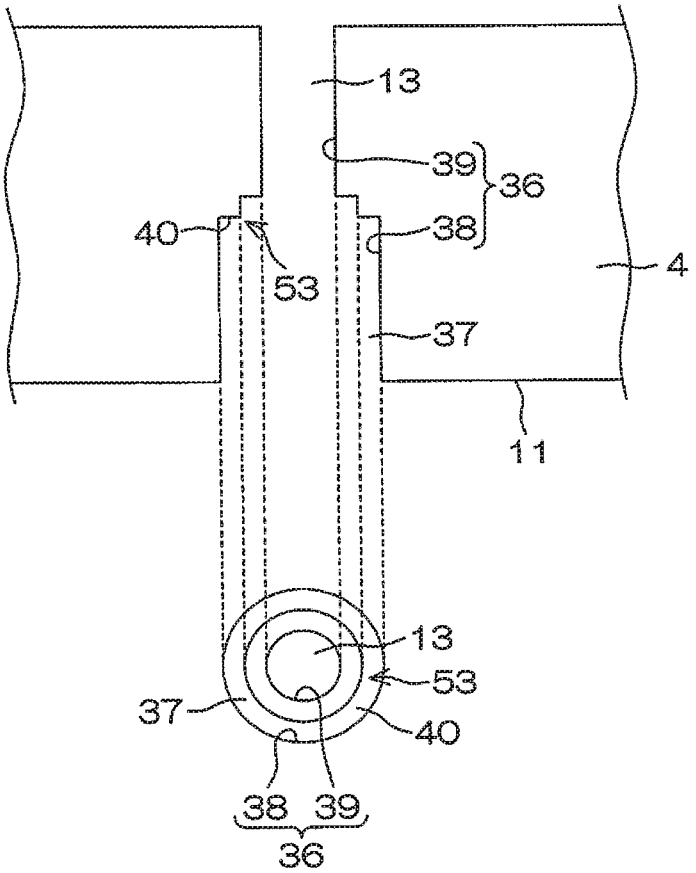
FIG. 10D shows a variation of the shape of an ink feed passage of the protection substrate.

In the structure shown in FIG. 10D, the carved part 37 includes several step structures 53 (in FIG. 10D, two step). The widths of the step structures 53 are stepwise narrower step by step so as to form several big diameter parts 38.

Figure 10E:
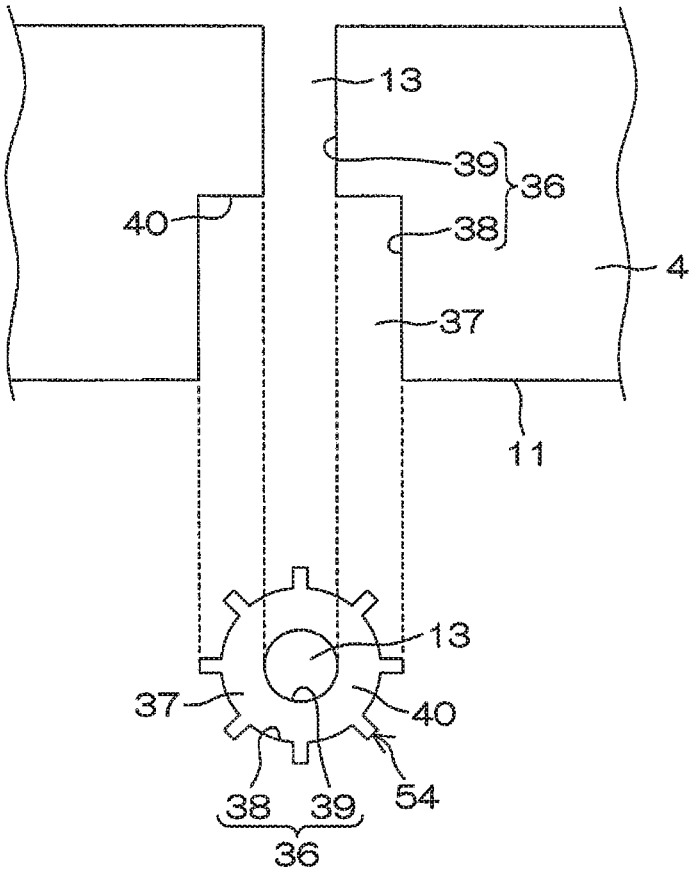
FIG. 10E shows a variation of the shape of an ink feed passage of the protection substrate.
Figure 10F:
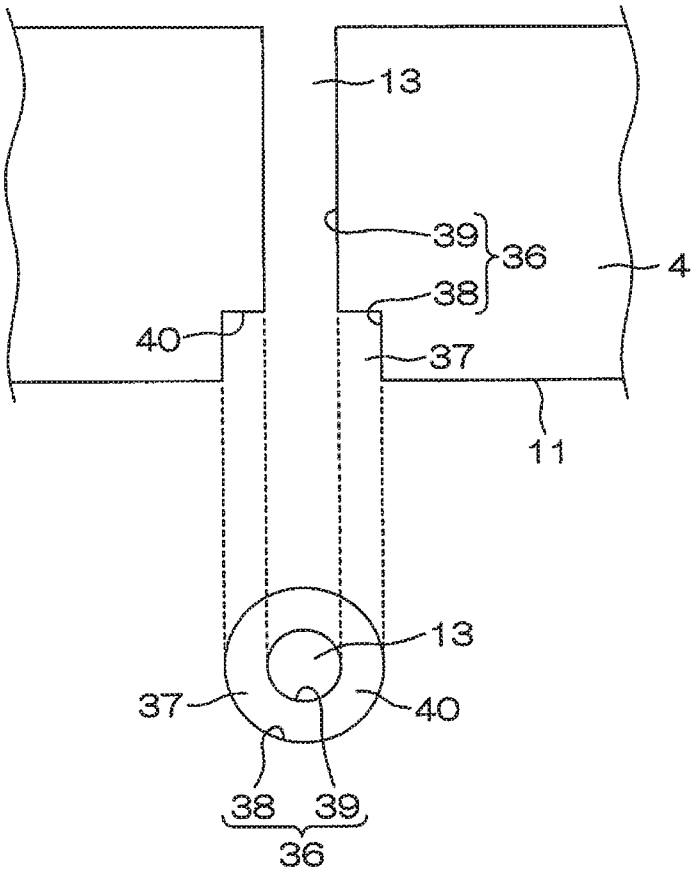
FIG. 10F shows a variation of the shape of an ink feed passage of the protection substrate.
Figure 10G:
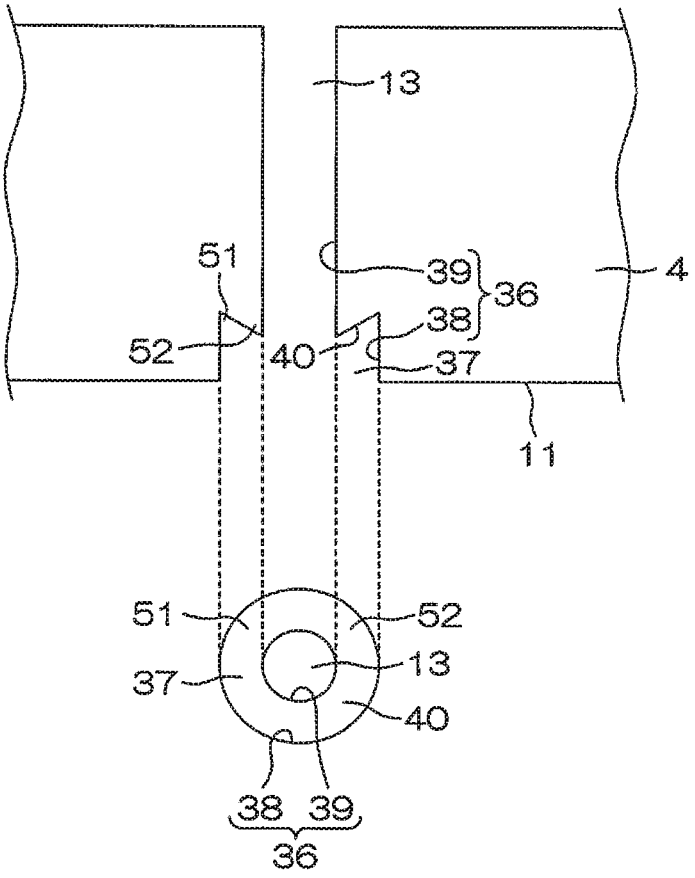
FIG. 10G shows a variation of the shape of an ink feed passage of the protection substrate.
Figure 10H:
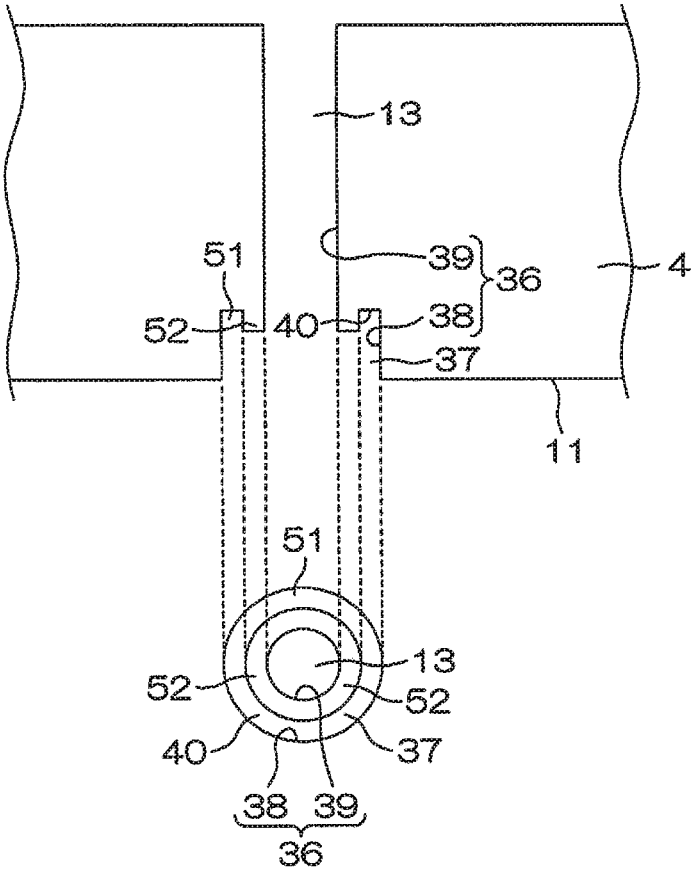
FIG. 10H shows a variation of the shape of an ink feed passage of the protection substrate.
Figure 10I:
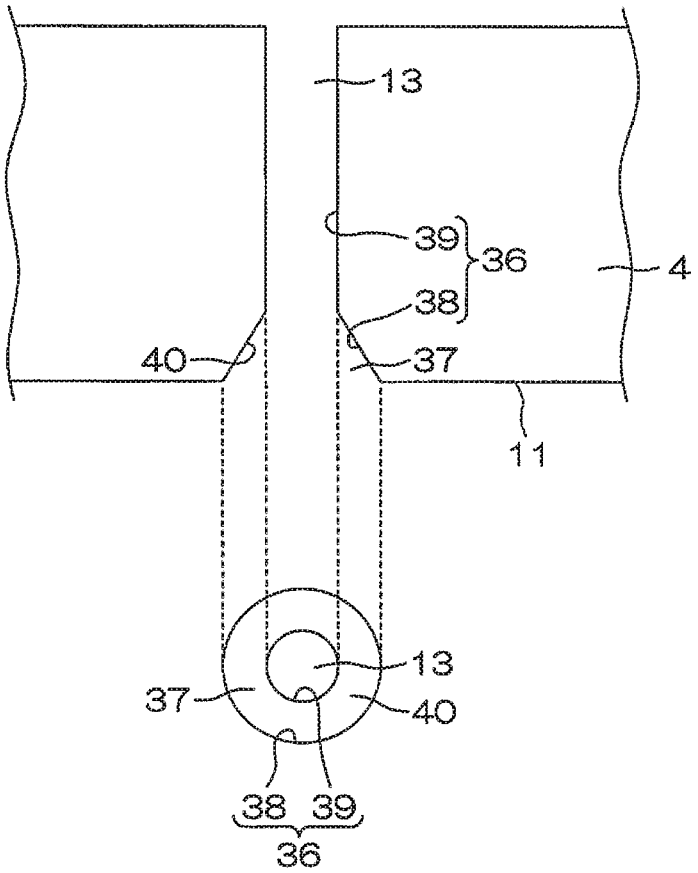
FIG. 10I shows a variation of the shape of an ink feed passage of the protection substrate.
Figure 10J:
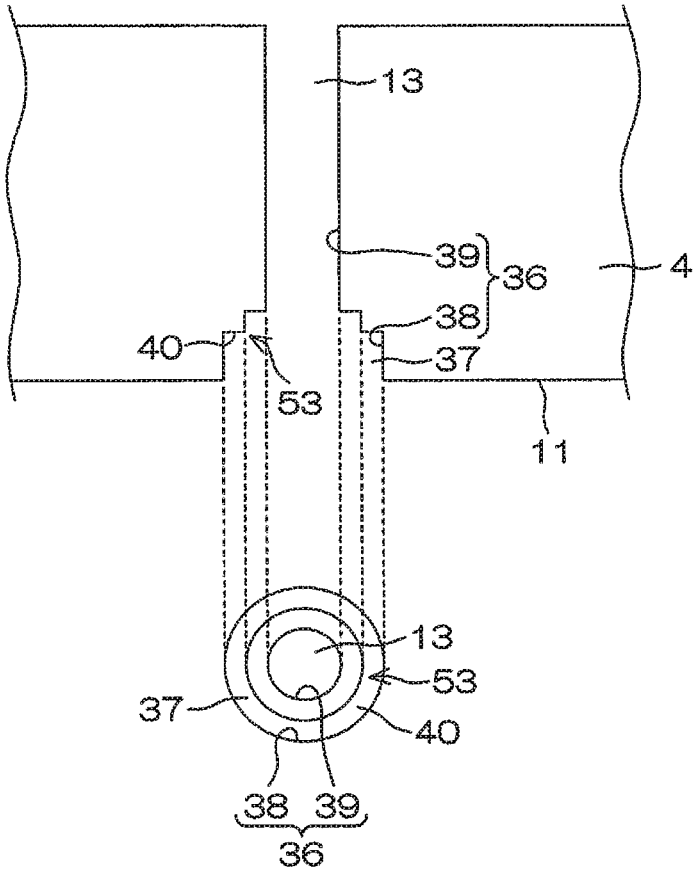
FIG. 10J shows a variation of the shape of an ink feed passage of the protection substrate.
Figure 10K:
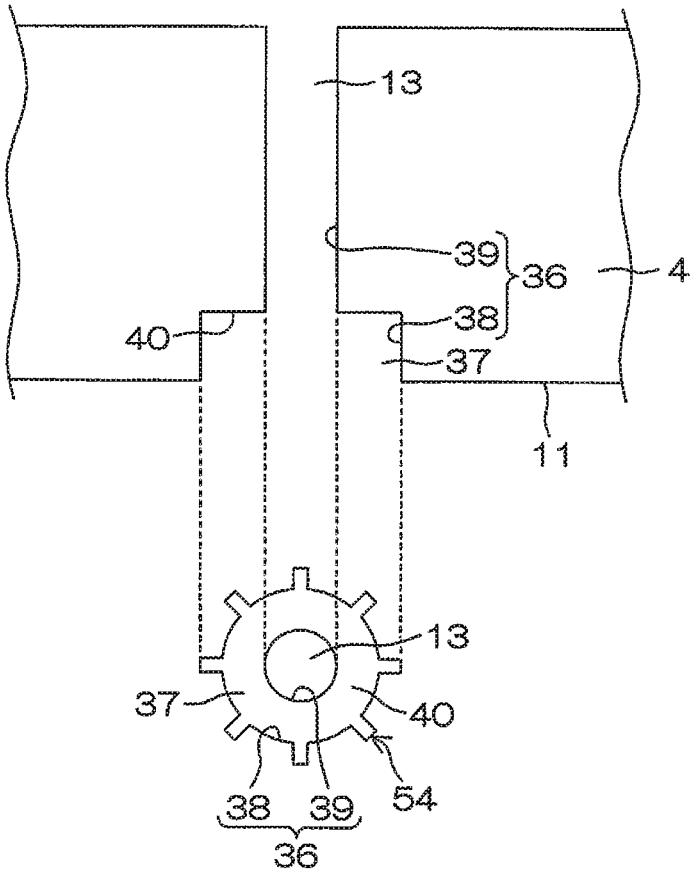
FIG. 10K shows a variation of the shape of an ink feed passage of the protection substrate.

In the structure shown in FIG. 10E, the carved part 37 includes radial portions 54 extending from the side surface of the big diameter part 38. The radial portions 54 are formed by, for example, arranging several fin-like grooves along the side surface of the through hole 36 with even intervals. In the structure shown in FIG. 10E, the adhesives can be prevented from flowing into the carved part 37 at one time.

Therefore, FIG. 10F~FIG. 10K respectively show the structure in which the carved parts 37 shown as FIG. 6 and FIG. 10A~FIG. 10E are formed on the surface of the opposed face 11 of the protection substrate 4 structure. In FIG. 6 and FIG. 10A~FIG. 10E, the carved parts 37 are formed nearly at the center of the thickness direction of the protection substrate 4.

(4) A Variation of the Shape of the Ink Feed Passage 13 of the Protection Substrate 4

Figure 11A:
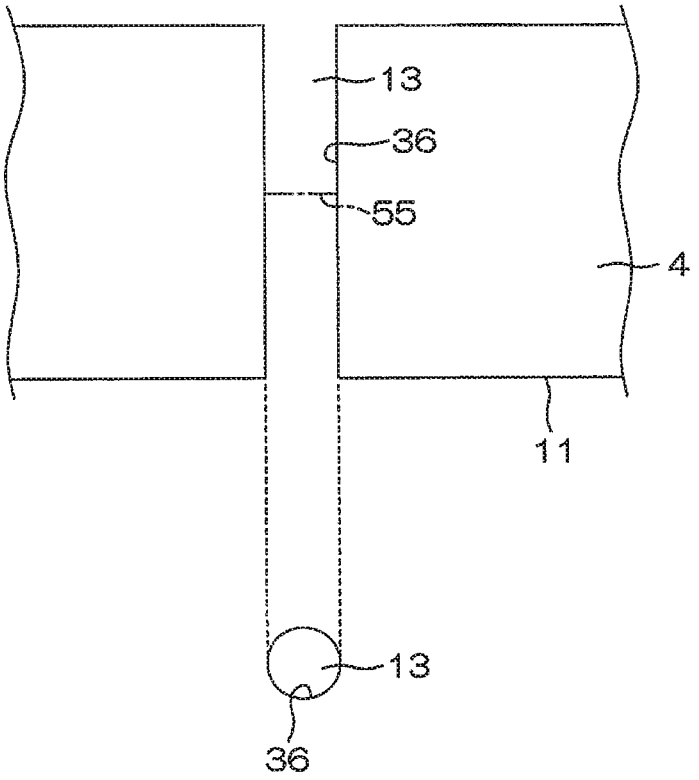
FIG. 11A shows a variation of the shape of an ink feed passage of the protection substrate.
Figure 11B:
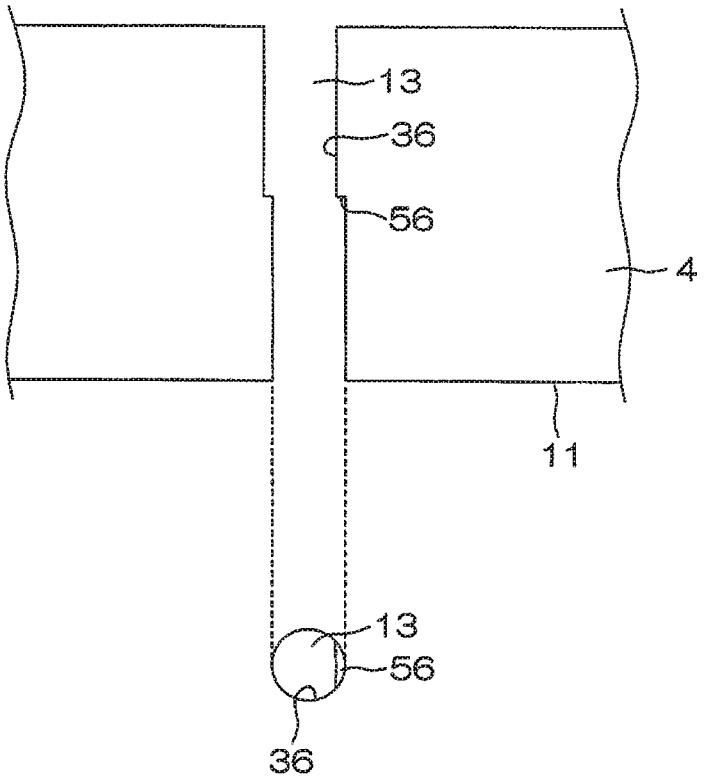
FIG. 11B shows a variation of the shape of an ink feed passage of the protection substrate.
Figure 11C:
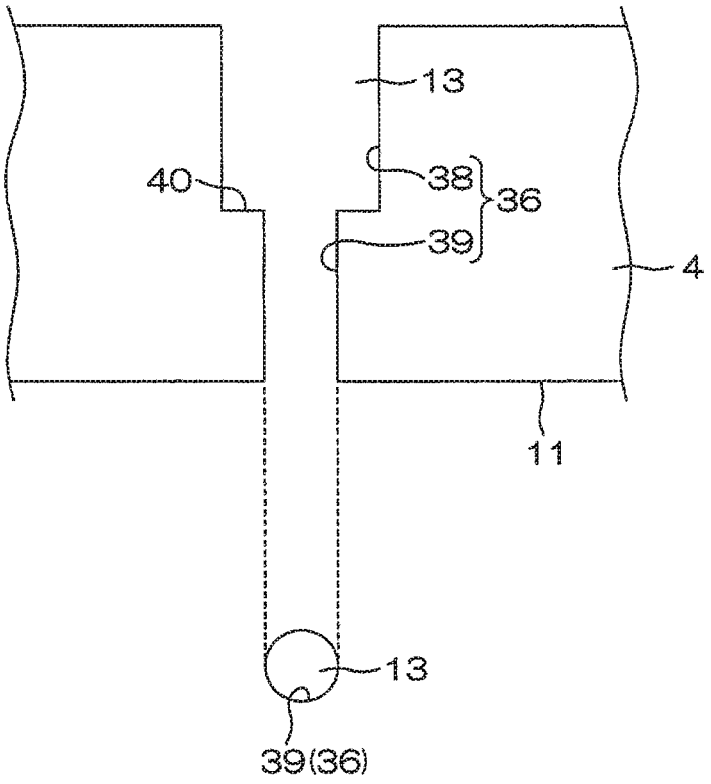
FIG. 11C shows a variation of the shape of an ink feed passage of the protection substrate.

FIG. 11A~FIG. 11C show variations of the shape of the ink feed passage 13 of the protection substrate 4.

Focus on ⌈(4) Operation and effect about a method for forming the through hole 36 (the ink feed passage 13) of the protection substrate 4⌋ mentioned earlier. When etching the rear surface from the protection substrate 4 to penetrate the hole 46 (FIG. 7F), the etching may be performed with the same etching size as the diameter of the hole 46. In this instance, the carved part 37, the big diameter part 38, and the small diameter part 39 are not formed. However, the through hole 36 may include a joint 55 (the structure shown in FIG. 11A) or a step difference 56 (the structure shown in FIG. 11B) generated by a slight deviation of the etching positions at the middle of the thickness direction of the protection substrate 4 (in such embodiment, nearly the middle part).

In the structure shown in FIG. 11C, the small diameter part 39 is formed on the opposed face 11 side of the protection substrate 4, and the big diameter part 38 is formed on the side opposite to the opposed face 11. In other words, the positional relation between the big diameter part 38 and the small diameter part 39 is inverted to the structure shown in FIG. 6. According to such structure, ⌈<Operation and effect> (5) Operation and effect about the shape of the through hole 36 (the ink feed passage 13) of the protection substrate 4⌋ can also be achieved. Further, to form the through hole 36 as the structure shown in FIG. 11C, for example, when forming the hole 46 with the same diameter as the big diameter part 38 and penetrating the hole 46 in the process shown in FIG. 7C, an etching is performed to etch the protection substrate 4 with the same etching size as the small diameter part 39.

(5) A Variation of the Pattern of the Upper Wiring 25

FIG. 12A~FIG. 12H show variations of the pattern of the upper wiring 25.

Figure 12A:
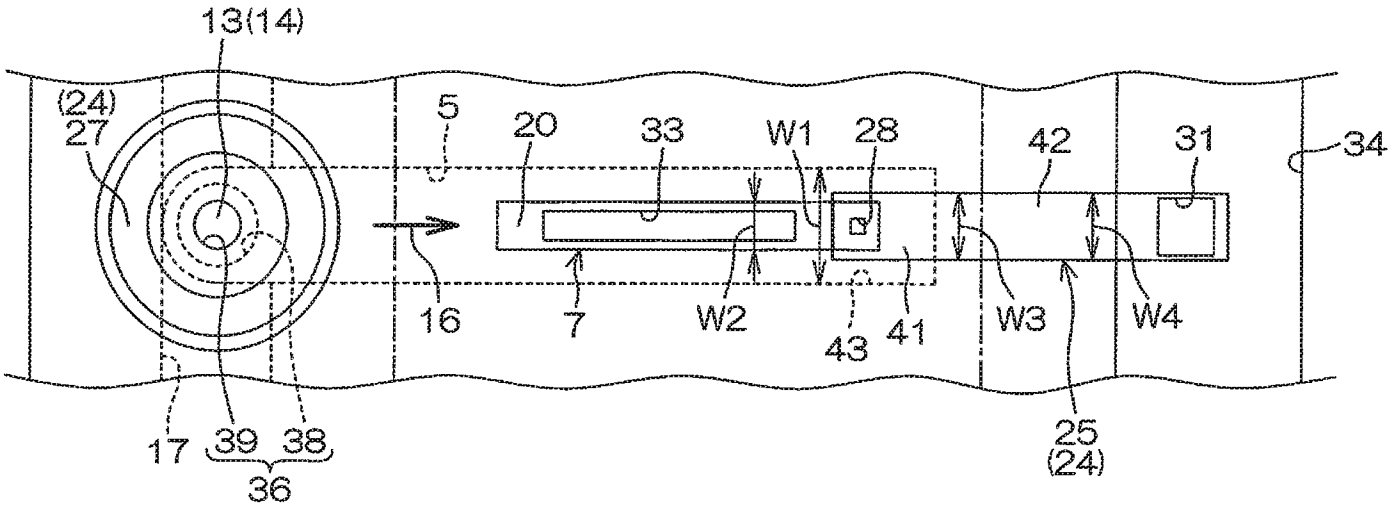
FIG. 12A shows a variation of the pattern of a wiring for driving the piezoelectric film.

In the structure shown in FIG. 12A, the width W3 of the first region 41 of the upper wiring 25 is equal to the width W4 of the second region 42. In other words, the upper wiring 25 is formed in a fixed width. Also, the relationship among the width W2 of the upper electrode 20, the width W3, W4, and the width W1 of the cavity 5 is the width W2<the width W3=the width W4<the width W1.

Figure 12B:
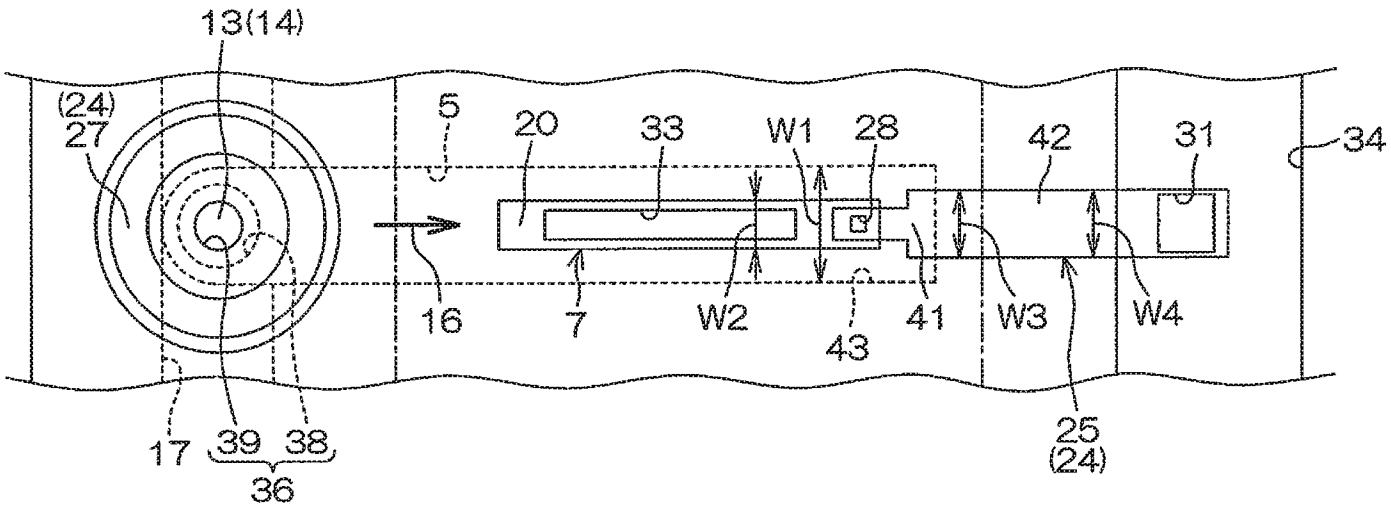
FIG. 12B shows a variation of the pattern of a wiring for driving the piezoelectric film.

In the structure shown in FIG. 12B, the contact (a part near the through hole 28) to the upper electrode 20 on the first region 41 is selectively narrower than the width W2 of the upper electrode 20 to the structure shown in FIG. 12A. On the other hand, in a part across the boundary region 43, the width W3 of the first region 41, like the structure shown in FIG. 12A, is larger than the width W2 of the upper electrode 20.

Figure 12C:
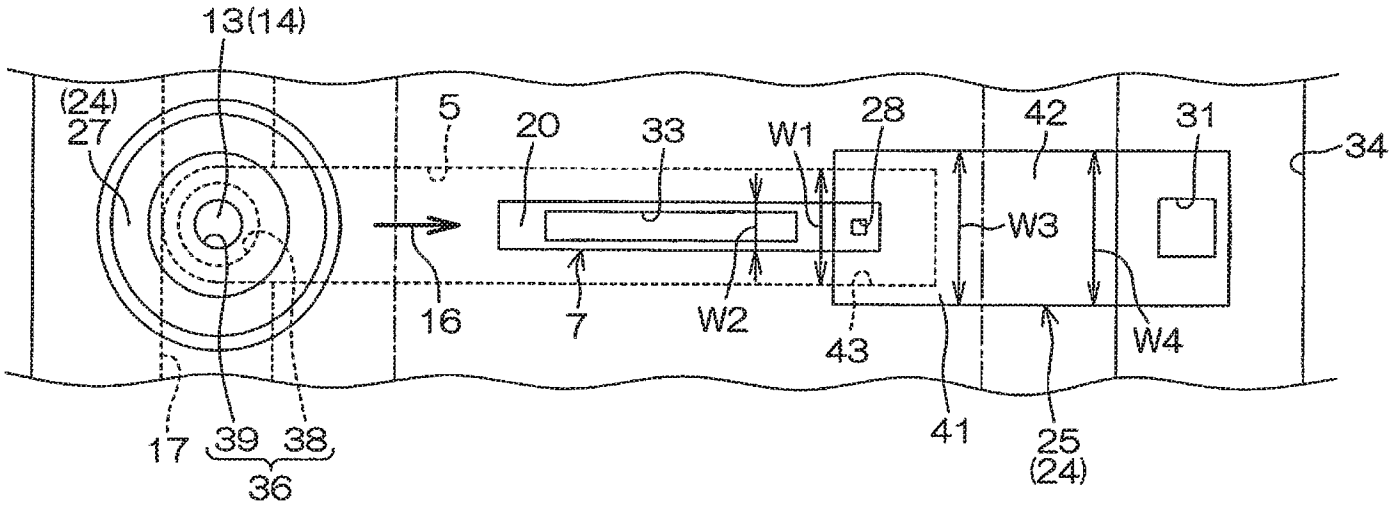
FIG. 12C shows a variation of the pattern of a wiring for driving the piezoelectric film.

In the structure shown in FIG. 12C, the relationship of the width W1~the width W4 is the width W2<the width W1<the width W3=the width W4 to the structure shown in FIG. 12A.

Figure 12D:
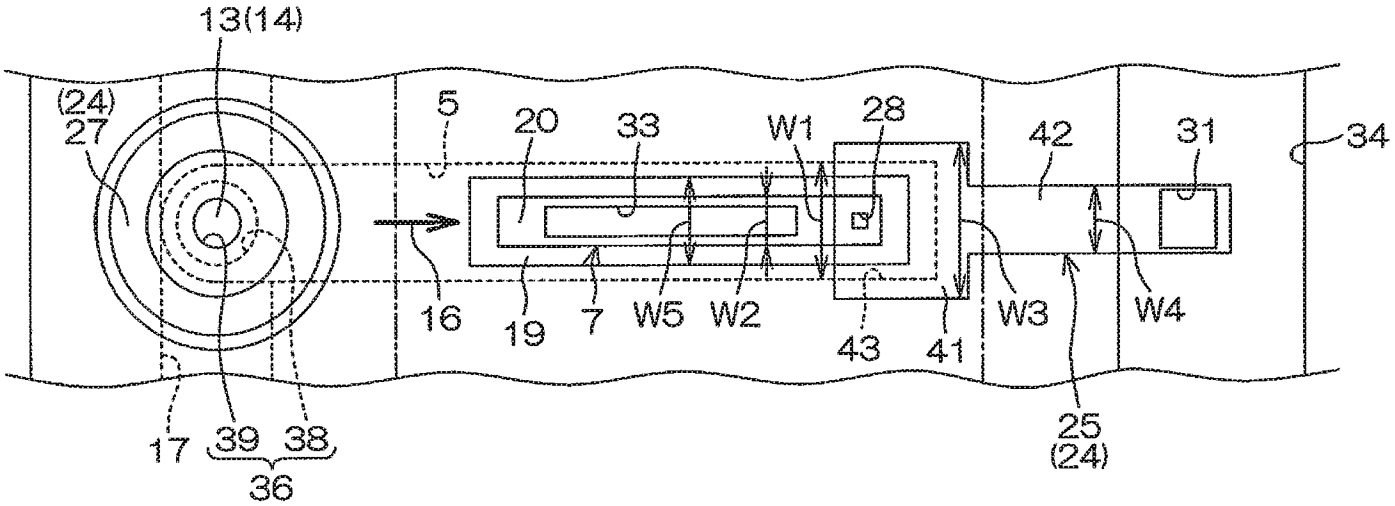
FIG. 12D shows a variation of the pattern of a wiring for driving the piezoelectric film.
Figure 12E:
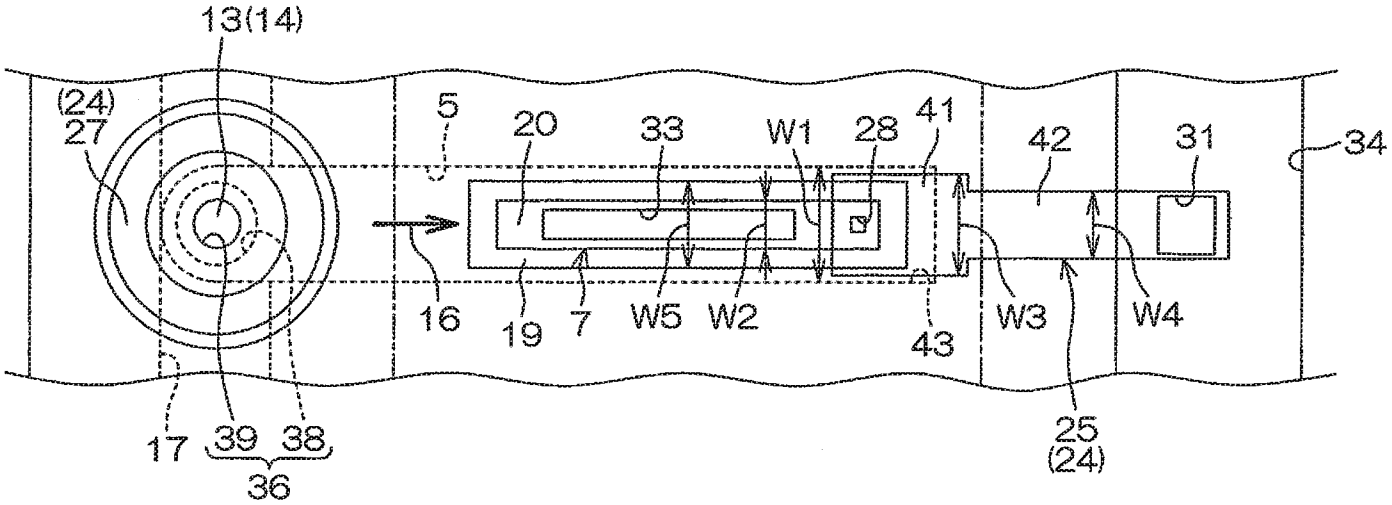
FIG. 12E shows a variation of the pattern of a wiring for driving the piezoelectric film.
Figure 12F:
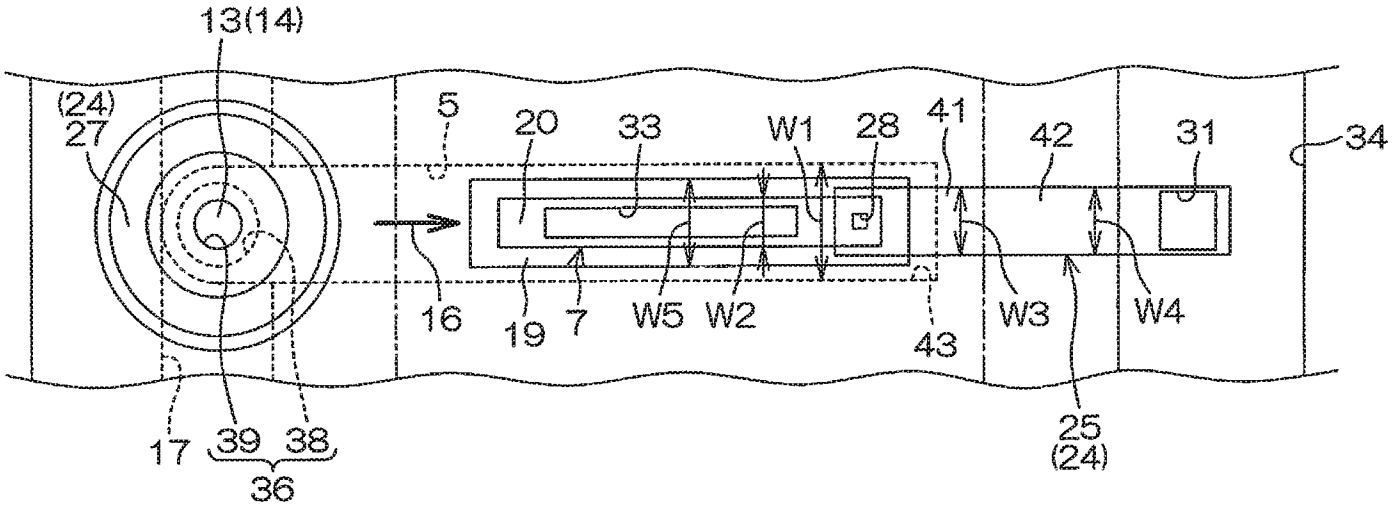
FIG. 12F shows a variation of the pattern of a wiring for driving the piezoelectric film.

In the structure shown in FIG. 12D, in a plane view, the piezoelectric film 19 is formed in a size constrained in the inner space of the cavity 5 to the structure in FIG. 1. Therefore, the relationship among the width W1 the width W4 and the width W5 of the piezoelectric film 19 is the width W2<the width W4<the width W5<the width W1<the width W3. Furthermore, in the structures shown in FIG. 12E and FIG. 12F, the relationships among the width W1~the width W5 are, respectively, the width W2<the width W4<the width W5<the width W3<the width W1 (FIG. 12E), and the width W2<the width W3=the width W4<the width W5<the width W1 (FIG. 12F), to the structure shown in FIG. 12D.

Figure 12G:
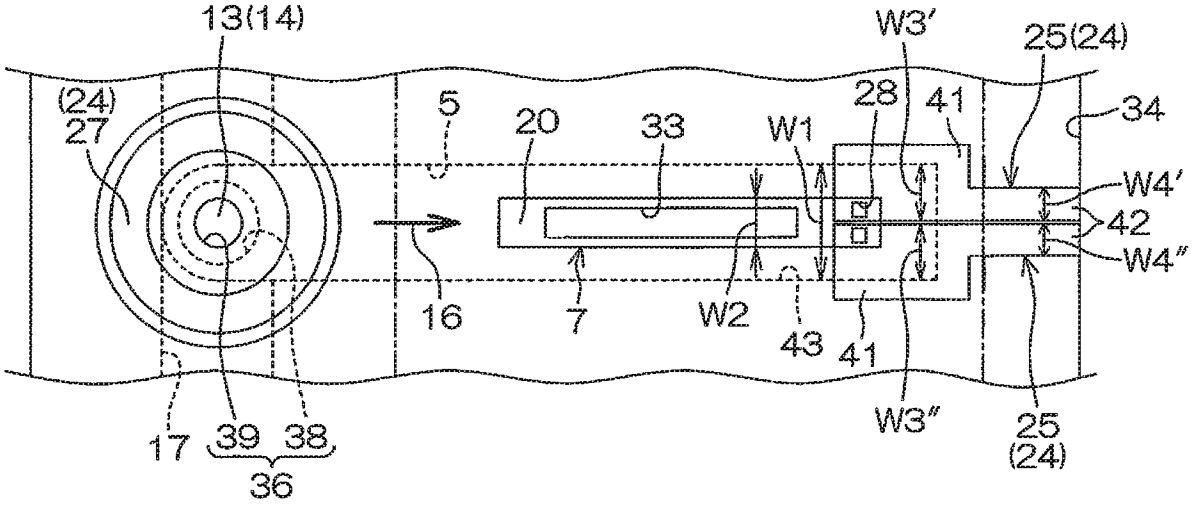
FIG. 12G shows a variation of the pattern of a wiring for driving the piezoelectric film.

In the structure shown in FIG. 12G, the upper wirings 25 include several wiring films 24. In this instance, if the total width of the width W3' of the first region 41 on one upper wiring 25 and the width W3" of the first region 41 on the other upper wiring 25 is larger than the width W2 of the upper electrode 20, then ⌈<Operation and effect> (6) Operation and effect about the pattern of the upper wiring 25 ⌋ described above can be achieved.

Figure 12H:
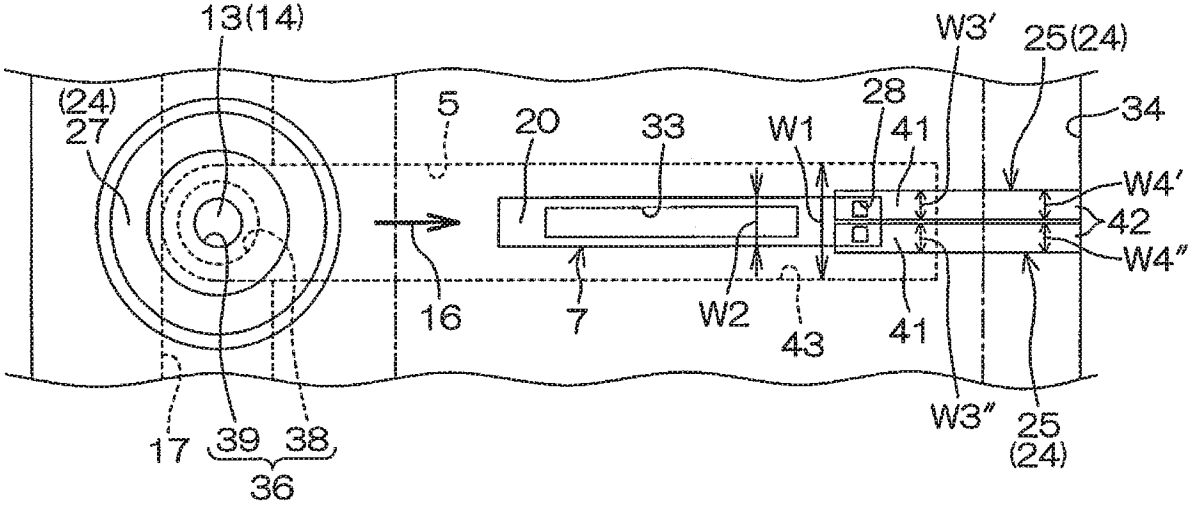
FIG. 12H shows a variation of the pattern of a wiring for driving the piezoelectric film.

In the structure shown in FIG. 12H, both the one upper wiring 25 and the other upper wiring 25 are formed in a fixed width (i.e., the width W3' (the width W3")=the width W4'(the width W4")) to the structure shown in FIG. 12G.

The embodiments of the present invention are illustrated above; however, the present invention can also be performed by other embodiments.

In addition, a variety of design changes can be applied within a range of the matters claimed in the claims.

Further, from the contents of the specification, other than the inventions claimed in the claim, a first invention and a second invention described as below can also be carried out.

(1) First Invention

<Problems to be Solved by a First Invention>

Generally, a piezoelectric body is formed under a high-temperature condition and then cooled so that it includes a tensile stress due to shrinking during the cooling. Therefore, in patent literature 1, at the time of removing silicon substrate material right below an elastic film to form the pressure generating chamber, the elastic film is pulled by a large tension due to the stress of the piezoelectric layer. This causes the displacement of the elastic film to get smaller. On the other hand, in the case of a tension compressing the elastic film, failures such as an unstable control of the amount of displacement due to a large slack of the elastic film may be generated.

In one embodiment of the present invention, an inkjet apparatus and a manufacturing method of an inkjet apparatus capable of displacing a vibrating film is favorably provided.

<Technical Means for Solving the Problems>

In one embodiment of the present invention, an inkjet apparatus is provided, wherein the inkjet apparatus includes: an actuator substrate, partitioning a cavity for accumulating ink; a vibrating film, supported by the actuator substrate and partitioning the cavity; and a piezoelectric element, arranged on the vibrating film, and including a piezoelectric film displacing the vibrating film to change the volume of the cavity; and the vibrating film has a compressive stress, while the piezoelectric film has a tensile stress.

Once a driving voltage is applied to the piezoelectric element, the vibrating film displaces together with the piezoelectric element, and the volume change of the cavity is caused. Thus, ink in the cavity is ejected. Since the piezoelectric film has a tensile stress opposite in direction to the vibrating film, the compressive stress generated in the vibrating film can be counterbalanced. In this way, the tensions applied on the vibrating film can be brought close to zero. Accordingly, at the time of driving the piezoelectric element, the vibrating film can be favorably displaced. Therefore, the extent of displacement necessary for ejecting ink can be provided.

In one embodiment of the present invention, an absolute value of an average stress of the vibrating film and the piezoelectric film is ≤100 MPa.

In one embodiment of the present invention, a passivation film is further included, wherein the passivation film is formed so as to selectively expose a space for the piezoelectric element, and having the thickness ≥0.5 times of the piezoelectric film.

In one embodiment of the present invention, a passivation film formed to further cover the piezoelectric element is included, and an absolute value of an average stress of the vibrating film, the piezoelectric film, and the passivation film is ≤50 MPa.

In one embodiment of the present invention, an absolute value of an average stress of the vibrating film and several upper layer films are ≤100 MPa, wherein the upper layer films are arranged higher than the vibrating film as viewed from the actuator substrate 2 and including the piezoelectric film.

In one embodiment of the present invention, a compressive stress of the vibrating film is between −300 MPa and −100 MPa, and a tensile stress of the piezoelectric film is between 100 MPa and 300 MPa.

In one embodiment of the present invention, the piezoelectric film has almost the same thickness as the vibrating film.

In one embodiment of the present invention, the thickness of the vibrating film and the piezoelectric film is between 1 μm and 5 μm.

In one embodiment of the present invention, the piezoelectric element includes an upper electrode and a lower electrode sandwiching the piezoelectric film, and having the thickness ≤0.2 times of the piezoelectric film.

In one embodiment of the present invention, the upper electrode includes a Pt mono-layer film.

In one embodiment of the present invention, the lower electrode includes a Pt/Ti laminated film.

In one embodiment of the present invention, the piezoelectric film includes a PZT film.

In one embodiment of the present invention, the vibrating film includes a $SiO_2$ mono-layer film.

In one embodiment of the present invention, the vibrating film includes a $SiN/SiO_2$ laminated film.

One embodiment of the present invention further includes a nozzle substrate, wherein the nozzle substrate supports the actuator substrate and partitions the cavity, and has a nozzle outlet communicating with the cavity.

In one embodiment of the present invention, a manufacturing method of inkjet apparatus is provided, wherein the manufacturing method of the inkjet apparatus includes: forming a vibrating film having a compressive stress on an actuator substrate; forming a piezoelectric element including a piezoelectric film having a tensile stress on the vibrating film; and etching the actuator substrate from a lower side in a region opposite to the vibrating film to form a cavity.

In one embodiment of the present invention, the vibrating film is formed by a plasma CVD method adopting predetermined film formation conditions.

By controlling the film formation conditions (such as gas pressure) during the implementation of plasma CVD, the compressive stress of the vibrating film can be easily adjusted.

In one embodiment of the present invention, the piezoelectric film is formed by a sol-gel method or a sputtering method adopting predetermined film formation conditions.

By controlling the film formation conditions during the implementation of a sol-gel method and a sputtering method, the tensile stress of the piezoelectric film can be easily adjusted.

(2) Second Invention

<Problems to be Solved by a Second Invention>

In the inkjet type recording head of the patent literature 1, several through holes (for example, reference number 33, 43) is formed on a protection substrate of a piezoelectric element. These through holes are generally formed by etching the protection substrate; however, the etching rate is reduced as the etching depth is increased. Accordingly, a long time is required for penetrating through the protection substrate.

Also, the larger the etching size becomes, the larger the etching rate becomes. So in the case of several through holes differing from each other, a failure such as over etching (undercut) in the larger through hole may occur.

Furthermore, the through hole is of course preferably formed as a designed size.

In one embodiment of the present invention, a manufacturing method of an inkjet apparatus capable of shortening the etching time required for forming a through hole on a protection substrate, and the inkjet apparatus thereby obtained are provided.

Also, in one embodiment of the present invention, a manufacturing method of an inkjet apparatus capable of suppressing or preventing the over etching occurs while forming a through hole on a protection substrate, and the inkjet apparatus thereby obtained are provided.

Furthermore, in one embodiment of the present invention, a manufacturing method of an inkjet apparatus capable of forming a through hole on a protection substrate in a designed size, and the inkjet apparatus thereby obtained are provided.

<Technical Means for Solving the Problems>

In one embodiment of the present invention, an inkjet apparatus is provided, wherein the inkjet apparatus includes: an actuator substrate, partitioning a cavity for accumulating ink; a vibrating film, supported by the actuator substrate and partitioning the cavity; a piezoelectric element, arranged on the vibrating film, and displacing the vibrating film to change the volume of the cavity; an ink feed passage, communicating with the cavity; and a protection substrate, fixed on the actuator substrate so as to cover the piezoelectric element, and including a first through hole communicating with the ink feed passage; and the first through hole successively includes a small diameter part and a big diameter part with a larger diameter than that of the small diameter part from an opposed face to the actuator substrate.

In one embodiment of the present invention, an inkjet apparatus is provided, wherein the inkjet apparatus includes: an actuator substrate, partitioning a cavity for accumulating ink; a vibrating film, supported by the actuator substrate and partitioning the cavity; a piezoelectric element, arranged on the vibrating film, and displacing the vibrating film to change the volume of the cavity; an ink feed passage, communicating with the cavity; and a protection substrate, fixed on the actuator substrate so as to cover the piezoelectric element, and including a first through hole communicating with the ink feed passage; and the first through hole successively includes a small diameter part and a big diameter part with a larger diameter than that of the small diameter part from an opposite side from the opposed surface to the actuator substrate.

In one embodiment of the present invention, the protection substrate includes a second through hole with a larger diameter than that of the first through hole.

In one embodiment of the present invention, a wiring is included, wherein the wiring is electrically connected to the piezoelectric element, extends over a region outside of the cavity, and exposes partially as a pad; a pad region including the pad is exposed within the second through hole.

In one embodiment of the present invention, the piezoelectric element includes an upper electrode, a lower electrode, and a piezoelectric film between the upper electrode and the lower electrode; the wiring includes a first wiring connected to the upper electrode, and a second wiring connected to the lower electrode.

In one embodiment of the present invention, an aspect ratio (an opening depth/an opening width) of the first through hole is ≥10 times of an aspect ratio of the second through hole.

In one embodiment of the present invention, a thickness of the protection substrate is between 200 μm and 500 μm; an opening width of the first through hole is between 30 μm and 50 μm; and an opening width of the second through hole is between 300 μm to 1500 μm.

In one embodiment of the present invention, the small diameter part and the big diameter part are connected through a step surface arranged at the middle of the thickness direction of the protection substrate.

In one embodiment of the present invention, the step surface is arranged nearly at the center of the thickness direction of the protection substrate.

In one embodiment of the present invention, the step surface is formed in a ring shape surrounding the small diameter part.

In one embodiment of the present invention, the protection substrate includes a recess in the space covering the piezoelectric element, and the piezoelectric element is arranged in the recess.

In one embodiment of the present invention, a manufacturing method of an inkjet apparatus is provided, wherein the method includes: etching a protection substrate including a first surface and a second surface opposite to the first surface form the first surface to form the first hole to the middle of the thickness direction; etching the protection substrate from a first region opposite to the first hole on the second surface of the protection substrate till the first hole is penetrated through to form a first through hole on the first region; preparing an actuator substrate successively forming a vibrating film with an ink feed passage and a piezoelectric element from a front side; and fixing the actuator substrate on the protection substrate so that the first through hole coincides with the ink feed passage in a plane view.

To form the first through hole, the etching is preformed from the first surface and the second surface respectively, as compared with the case of etching from the first surface to the second surface at one time the depth of the single etching may be shallower. Thus, the average etching rate till the first through hole is formed can be improved. As a result, the etching time required for forming the first through hole can be shortened.

One embodiment of the present invention further includes: etching the protection substrate from a second region horizontally shifted from the first region simultaneously with the etching of the first region, with an etching width larger than that of the first through hole to form a second through hole.

In the region for forming the first through hole with the relatively small etching size, the first hole is previously formed; thus, if the substrate material is etched from the first region with a thickness having reduced the depth of the first hole from the thickness of the protection substrate, the through hole 36 can be formed. Therefore, although etching rates differ between the first region and the second region, the variation of the timing that the through holes are formed in the respective region (i.e., a completion time of etching) is eliminated. Thus allowing the first through hole and the second through hole to be formed with approximately the same timing. As a result, the occurrence of over etching can be suppressed or prevented.

In one embodiment of the present invention, during the formation of the first through hole, a first through hole is formed by etching the protection substrate with an etching width differing from that of the first hole. The first through hole includes a small diameter part and a big diameter part with a larger diameter than that of the small diameter part successively formed from one of the first surface or second surface.

At the time of etching the protection substrate from the side opposite (the first region) to the first hole, if the etching size is almost the same as the first hole, due to the misalignment, or other errors, there is concern that the step is generated on the joint portion of the through hole (at the middle part of the thickness direction of the protection substrate), and the diameter becomes smaller than the designed value. Thus, by setting the machining dimensions of the big diameter part as the size in consideration of the extent of the misalignment, at least the diameter corresponding to the small diameter part can be secured. Thus, by forming the small diameter part according to the designed value of the first through hole, the first through hole with the diameter as designed can be provided. Further, the earlier formed first hole may be set to the big diameter part, or the small diameter part.

In one embodiment of the present invention, the first hole is formed so as to position the bottom nearly at the center of the thickness direction of the protection substrate.

In one embodiment of the present invention, a manufacturing method of a protection substrate for an inkjet apparatus is provided, wherein the method includes: etching a protection substrate including a first surface and a second surface opposite to the first surface form the first surface to form the first hole to the middle of the thickness direction; and etching the protection substrate from a first region opposite to the first hole on the second surface of the protection substrate till penetrating through the first hole to form a first through hole on the first region.

To form the first through hole, the etching is preformed from the first surface and the second surface respectively, as compared with the case of etching from the first surface to the second surface at one time, the depth of the single etching may be shallower. Thus, the average etching rate till the first through hole is formed can be improved. As a result, the etching time required for forming the first through hole can be shortened.

One embodiment of the present invention further includes: etching the protection substrate from a second region horizontally shifted from the first region simultaneously with the etching of the first region, with an etching width larger than that of the first through hole to form a second through hole.

In the region for forming the first through hole with the relatively small etching size, the first hole is previously formed. Thus, if the substrate material is etched from the first region with a thickness having reduced the depth of the first hole from the thickness of the protection substrate, the through hole 36 can be formed. Therefore, although etching rates differ between the first region and the second region, the variation of the timing that the through holes are formed in the respective region (i.e., a completion time of etching) is eliminated. Thus allowing the first through hole and the second through hole to be formed with approximately the same timing. As a result, the occurrence of over etching can be suppressed or prevented.

In one embodiment of the present invention, during the formation of the first through hole, a first through hole is formed by etching the protection substrate with an etching width differing from that of the first hole. The first through hole includes a small diameter part and a big diameter part with a larger diameter than that of the small diameter part successively formed from one of the first surface or second surface.

By setting the machining dimensions of the big diameter part as the size in consideration of the extent of the misalignment, at least the diameter corresponding to the small diameter part can be secured. Thus, by forming the small diameter part according to the designed value of the first through hole, the first through hole with the diameter as designed can be provided.

In one embodiment of the present invention, the first hole is formed so as to position the bottom nearly at the center of the thickness direction of the protection substrate.

What is claimed is:

1. An inkjet apparatus, comprising:

an actuator substrate, defining a cavity for accumulating ink;

a vibrating film, supported by the actuator substrate and defining a side wall of the cavity; and a piezoelectric element on the vibrating film, and including a piezoelectric film for displacing the vibrating film to change a volume of the cavity, wherein the vibrating film has a compressive stress, and the piezoelectric film has a tensile stress, and an absolute value of an average stress of the vibrating film and the piezoelectric film is ≤100MPa.

2. The inkjet apparatus according to claim 1, further comprising a passivation film, wherein the passivation film is formed to selectively expose a portion of the piezoelectric element, and has a thickness equal to or greater than 0.5 times of a thickness of the piezoelectric film.

3. The inkjet apparatus according to claim 1, further comprising a passivation film formed to cover the piezoelectric element, and an absolute value of an average stress of the vibrating film, the piezoelectric film, and the passivation film is ≤50MPa.

4. The inkjet apparatus according to claim 1, wherein an absolute value of an average stress of the vibrating film and a plurality of upper layer films is ≤100MPa, wherein the plurality of upper layer films is arranged higher than the vibrating film as viewed from the actuator substrate and including the piezoelectric film.

5. The inkjet apparatus according to claim 1, wherein a compressive stress of the vibrating film is between −300MPa and −100MPa, and a tensile stress of the piezoelectric film is between 100MPa and 300MPa.

6. The inkjet apparatus according to claim 1, wherein the piezoelectric film has substantially the same thickness as the vibrating film.

7. The inkjet apparatus according to claim 1, wherein a thickness of the vibrating film and a thickness of the piezoelectric film are between 1 μm and 5 μm.

8. The inkjet apparatus according to claim 1, wherein the piezoelectric element includes an upper electrode and a lower electrode sandwiching the piezoelectric film, and at least one of the upper electrode and the lower electrode has a thickness ≤0.2 times of a thickness of the piezoelectric film.

9. A manufacturing method of an inkjet apparatus, comprising:

forming, on an upper side of an actuator substrate, a vibrating film having a compressive stress;

forming, on the vibrating film, a piezoelectric element including a piezoelectric film having a tensile stress;

adjusting an absolute value of an average stress of the vibrating film and the piezoelectric film to be ≤100MPa by controlling conditions for forming the vibrating film and the piezoelectric film; and etching the actuator substrate from a lower side, opposite the upper side, in a region opposite to the vibrating film to form a cavity.

10. The method of claim 9, wherein the vibrating film is formed by a plasma CVD (Chemical Vapor Deposition) under predetermined film formation conditions.

11. The method of claim 9, wherein the piezoelectric film is formed by a sol-gel method or a sputtering under predetermined film formation conditions.

* * * * *